US005666789A

United States Patent [19]

Ziegler

[11] Patent Number: 5,666,789

[45] Date of Patent: Sep. 16, 1997

[54] STACKED ARTICLE CARTONING APPARATUS

[75] Inventor: Kelly W. Ziegler, Crosby, Minn.

[73] Assignee: Riverwood International Corporation, Atlanta, Ga.

[21] Appl. No.: 518,582

[22] Filed: Aug. 23, 1995

Related U.S. Application Data

[63] Continuation of Ser. No. 343,836, Nov. 22, 1994, Pat. No. 5,456,058, which is a continuation of Ser. No. 22,661, Mar. 1, 1993, abandoned.

[51] Int. Cl.[6] ..... B65B 5/06; B65B 35/50

[52] U.S. Cl. ..... 53/447; 53/48.1; 53/157; 53/252; 53/540; 53/566

[58] Field of Search ..... 53/447, 566, 540, 53/157, 152, 156, 252, 251, 250, 48.1, 48.7, 48.5

[56] References Cited

U.S. PATENT DOCUMENTS

| | | | |
|---|---|---|---|
| 1,824,432 | 9/1931 | Hendry | 53/566 X |
| 2,561,541 | 7/1951 | Stake . | |
| 2,644,625 | 7/1953 | Currivan | 53/252 |
| 2,907,155 | 10/1959 | Engleson et al. | 53/252 X |
| 3,282,585 | 11/1966 | Dieter | 271/3 |
| 3,453,800 | 7/1969 | Mahncke . | |
| 3,701,407 | 10/1972 | Kulig . | |
| 3,778,959 | 12/1973 | Langen et al. | 53/48.1 X |
| 3,821,874 | 7/1974 | Jones . | |
| 3,845,852 | 11/1974 | Langen et al. | 53/252 X |
| 3,900,096 | 8/1975 | Nack et al. . | |
| 3,904,036 | 9/1975 | Forrer | 206/427 |
| 3,990,572 | 11/1976 | Fishback | 53/48.1 X |
| 4,007,830 | 2/1977 | Calvert | 206/175 |
| 4,023,328 | 5/1977 | Calvert et al. . | |
| 4,189,986 | 2/1980 | Silver . | |
| 4,206,579 | 6/1980 | Woxland | 53/484 |
| 4,237,673 | 12/1980 | Calvert et al. | 53/251 X |
| 4,251,978 | 2/1981 | Beck | 53/491 |
| 4,380,283 | 4/1983 | van Maanen | 198/456 |
| 4,514,964 | 5/1985 | Langen | 53/540 |
| 4,516,765 | 5/1985 | Stocco et al. | 271/95 |
| 4,566,248 | 1/1986 | Cooley | 53/543 X |
| 4,645,061 | 2/1987 | Welch | 198/420 |
| 4,646,908 | 3/1987 | Gambetti | 198/422 |
| 4,693,055 | 9/1987 | Olsen, Jr. et al. | 53/566 X |
| 4,709,538 | 12/1987 | Olsen, Jr. et al. | 53/566 |
| 4,735,600 | 4/1988 | Drewke et al. | 493/314 |
| 4,804,076 | 2/1989 | Pace | 198/475.1 |
| 4,817,779 | 4/1989 | Beck et al. | 198/365 |
| 4,832,178 | 5/1989 | Anderson et al. | 198/461 |

(List continued on next page.)

FOREIGN PATENT DOCUMENTS

| | | |
|---|---|---|
| 0017333 | 10/1980 | European Pat. Off. . |
| WO8300135 | 1/1983 | WIPO . |

OTHER PUBLICATIONS

APV Douglas Machine Corp., Alexandria, Minnesota, Video tape, "M-2207 Continuous Motion Wraparound Case Packer".

APV Douglas Machine Corp., Alexandria, Minnesota, "Mid-America Dairyman CMWACP Floor Plan", Aug. 23, 1989, Drawing No. FP-4690 C.

Pillsbury—Mead Machine Video tape, #1225, 129.

*Primary Examiner*—James F. Coan

*Attorney, Agent, or Firm*—Joel D. Skinner, Jr.; Steve M. McLary

[57] ABSTRACT

A cartoning apparatus for loading stacked article groups into carton sleeves. The cartoning apparatus comprises at least two article infeed mechanisms, each supplying at least one stream of articles at a predetermined height or level, an article selection and transport mechanism intersecting the article infeed mechanisms to form and move a stream of stacked article groups of a predetermined pattern, a carton supply and transport mechanism synchronized and moving parallel with said article selection and transport mechanism to provide cartons with open ends facing the moving article groups, and an article group transfer mechanism constructed and arranged to move article groups into the open ends of the carton sleeves.

18 Claims, 16 Drawing Sheets

US005666789A

United States Patent [19]

Ziegler

[11] Patent Number: 5,666,789

[45] Date of Patent: Sep. 16, 1997

[54] STACKED ARTICLE CARTONING APPARATUS

[75] Inventor: Kelly W. Ziegler, Crosby, Minn.

[73] Assignee: Riverwood International Corporation, Atlanta, Ga.

[21] Appl. No.: 518,582

[22] Filed: Aug. 23, 1995

Related U.S. Application Data

[63] Continuation of Ser. No. 343,836, Nov. 22, 1994, Pat. No. 5,456,058, which is a continuation of Ser. No. 22,661, Mar. 1, 1993, abandoned.

[51] Int. Cl.[6] ..... B65B 5/06; B65B 35/50

[52] U.S. Cl. ..... 53/447; 53/48.1; 53/157; 53/252; 53/540; 53/566

[58] Field of Search ..... 53/447, 566, 540, 53/157, 152, 156, 252, 251, 250, 48.1, 48.7, 48.5

[56] References Cited

U.S. PATENT DOCUMENTS

| | | | |
|---|---|---|---|
| 1,824,432 | 9/1931 | Hendry | 53/566 X |
| 2,561,541 | 7/1951 | Stake . | |
| 2,644,625 | 7/1953 | Currivan | 53/252 |
| 2,907,155 | 10/1959 | Engleson et al. | 53/252 X |
| 3,282,585 | 11/1966 | Dieter | 271/3 |
| 3,453,800 | 7/1969 | Mahncke . | |
| 3,701,407 | 10/1972 | Kulig . | |
| 3,778,959 | 12/1973 | Langen et al. | 53/48.1 X |
| 3,821,874 | 7/1974 | Jones . | |
| 3,845,852 | 11/1974 | Langen et al. | 53/252 X |
| 3,900,096 | 8/1975 | Nack et al. . | |
| 3,904,036 | 9/1975 | Forrer | 206/427 |
| 3,990,572 | 11/1976 | Fishback | 53/48.1 X |
| 4,007,830 | 2/1977 | Calvert | 206/175 |
| 4,023,328 | 5/1977 | Calvert et al. . | |
| 4,189,986 | 2/1980 | Silver . | |
| 4,206,579 | 6/1980 | Woxland | 53/484 |
| 4,237,673 | 12/1980 | Calvert et al. | 53/251 X |
| 4,251,978 | 2/1981 | Beck | 53/491 |
| 4,380,283 | 4/1983 | van Maanen | 198/456 |
| 4,514,964 | 5/1985 | Langen | 53/540 |
| 4,516,765 | 5/1985 | Stocco et al. | 271/95 |
| 4,566,248 | 1/1986 | Cooley | 53/543 X |
| 4,645,061 | 2/1987 | Welch | 198/420 |
| 4,646,908 | 3/1987 | Gambetti | 198/422 |
| 4,693,055 | 9/1987 | Olsen, Jr. et al. | 53/566 X |
| 4,709,538 | 12/1987 | Olsen, Jr. et al. | 53/566 |
| 4,735,600 | 4/1988 | Drewke et al. | 493/314 |
| 4,804,076 | 2/1989 | Pace | 198/475.1 |
| 4,817,779 | 4/1989 | Beck et al. | 198/365 |
| 4,832,178 | 5/1989 | Anderson et al. | 198/461 |

(List continued on next page.)

FOREIGN PATENT DOCUMENTS

| | | |
|---|---|---|
| 0017333 | 10/1980 | European Pat. Off. . |
| WO8300135 | 1/1983 | WIPO . |

OTHER PUBLICATIONS

APV Douglas Machine Corp., Alexandria, Minnesota, Video tape, "M-2207 Continuous Motion Wraparound Case Packer".

APV Douglas Machine Corp., Alexandria, Minnesota, "Mid-America Dairyman CMWACP Floor Plan", Aug. 23, 1989, Drawing No. FP-4690 C.

Pillsbury—Mead Machine Video tape, #1225, 129.

*Primary Examiner*—James F. Coan

*Attorney, Agent, or Firm*—Joel D. Skinner, Jr.; Steve M. McLary

[57] ABSTRACT

A cartoning apparatus for loading stacked article groups into carton sleeves. The cartoning apparatus comprises at least two article infeed mechanisms, each supplying at least one stream of articles at a predetermined height or level, an article selection and transport mechanism intersecting the article infeed mechanisms to form and move a stream of stacked article groups of a predetermined pattern, a carton supply and transport mechanism synchronized and moving parallel with said article selection and transport mechanism to provide cartons with open ends facing the moving article groups, and an article group transfer mechanism constructed and arranged to move article groups into the open ends of the carton sleeves.

18 Claims, 16 Drawing Sheets

STACKED ARTICLE CARTONING APPARATUS

This application is a continuation of application Ser. No. 08/343,836 filed Nov. 22, 1994 now U.S. Pat. No. 5,456,058 which is a continuation of Ser. No. 08/022,661 filed Mar. 1, 1993, abandoned.

BACKGROUND OF THE INVENTION

This invention relates to cartoning apparatus and methods used in the packaging industry. Particularly, this invention relates to continuous motion cartoner assemblies to load stacked or multiple layer article groups into cartons or packages, and specifically those constructed of paperboard. The cartoner assembly of the present invention is adjustable to package different types, styles and sizes of articles, such as cans and bottles, and a wide range of article group patterns, both stacked and unstacked, into cartons in a fast and reliable manner.

In the past, various machines and processes have been proposed and utilized to package selected article groups into cartons. Each prior art machine and process, however, accomplishes the packaging of the article groups in a distinct manner and utilizes particular machinery. Moreover, prior art cartoners have limited adjustability, limited output capability, and have been difficult to construct and maintain due to their respective designs. And finally, no method or apparatus, insofar as is known provides continuous motion cartoning of stacked or layered product groups.

Prior art cartoner assemblies include U.S. Pat. No. 4,802,324 to applicants' assignee for a Vertical Cartoning Assembly and Method which discloses the placement and assembly of cartons over preselected article groups being moved on a conveyor. U.S. Pat. No. 5,036,644, also to applicants' assignee, discloses a Packaging Sleever Assembly which transfers flat packaging sleeves directly onto preselected article groups and subsequently wraps and closes the cartons. Various end loading packaging machines have also been proposed in the art. For example, U.S. Pat. No. 3,778,959 to Langen et al. discloses an end loader which utilizes a plurality of transversely extending spaced apart fences or flights mounted on a conveyor to rake or capture a predetermined number of containers from infeed container slips. U.S. Pat. No. 4,237,673 to Calvert et al. discloses a machine al. so for loading container sleeves through their open ends. U.S. Pat. No. 4,936,077 to Langen et al. discloses a carton loading machine which utilizes pusher mechanisms with spring loaded pusher heads to stagger adjacent product group rows during transfer into the carton.

In view of the limitations and shortcomings of prior art methods and apparatus, it is an object of this invention to provide an apparatus which continuously and reliably cartons predetermined product groups at high speed. Another object of this invention is to provide a continuous motion cartoner which is fully adjustable for use with a variety of cartons, articles and article group types and sizes. A particular object of the invention is to provide a cartoner which processes stacked or multiple layer article groups.

SUMMARY OF THE INVENTION

The present invention provides a continuous motion cartoner assembly for loading stacked or vertically layered article groups into cartons which comprises an article infeed mechanism supplying at least two streams of articles at vertically distinct levels; an article group selection and transport mechanism intersecting the article infeed mechanism to form and transport a longitudinal stream of article groups of a predetermined stacked pattern; a carton supply and transport mechanism synchronized and moving parallel with the article group selecting mechanism to provide cartons with open ends facing the moving article groups; and an article group transfer mechanism constructed and arranged to move the article groups into the open ends of the carton sleeves.

This invention also provides a method of continuously loading cartons with stacked article groups having upper and lower sub-groups of at least one article, which comprises the steps of supplying an input stream of articles at a first location; selecting articles at the first location to form a lower article sub-group; transporting the lower article sub-group longitudinally to a second location; supplying an input stream of articles at the second location; selecting articles at the second location to form an upper article sub-group on top of the lower article sub-group to thereby form a stacked article group; supplying and longitudinally transporting a carton in spacial synchronization with the stacked article group; and laterally transferring the stacked article group into the longitudinally transported carton.

These and other benefits of this invention will become clear from the following description by reference to the drawings.

DESCRIPTION OF THE PREFERRED EMBODIMENT

Figure 1:
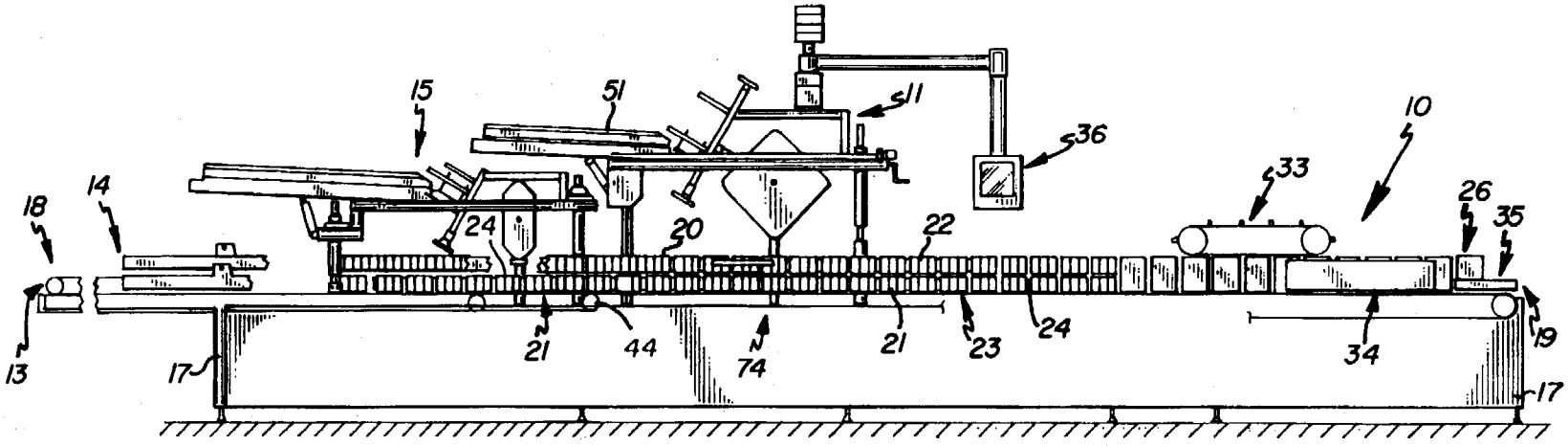
FIG. 1 is a side view of the cartoner assembly of the present invention.

The apparatus and methods of the present invention are for loading articles into cartons in a continuous, high speed process. As shown in the drawings, the apparatus 10 of this invention is particularly useful in a continuous, high-speed packaging operation, and in cooperation with synchronized, related packaging apparatus. The apparatus 10 is adjustable to provide reliable, continuous and high speed packaging of articles or products of varying types, sizes and quantities into cartons of varying types and sizes. For example, the apparatus 10 is useable to load standard twelve ounce beverage cans into 24(12/12), 30(15/15) and 36(18/18) pack stacked combinations and also into common single level 12, 15 and 18 pack configurations utilizing the adjustment features described more fully below. Moreover, the process of loading beverage containers into paperboard cartons, for example, is accomplished quickly and reliably, under typical industry tolerances for both container and carton construction. Finally, the resultant filled cartons output by the apparatus 10 are of high quality and consistency, having maximized squareness and tautness for improved storage qualities and transportability. Finally, the apparatus 10 of this invention provides high speed processing of approximately 60 to 250 or more cartons per minute depending upon carton size.

Figure 2:
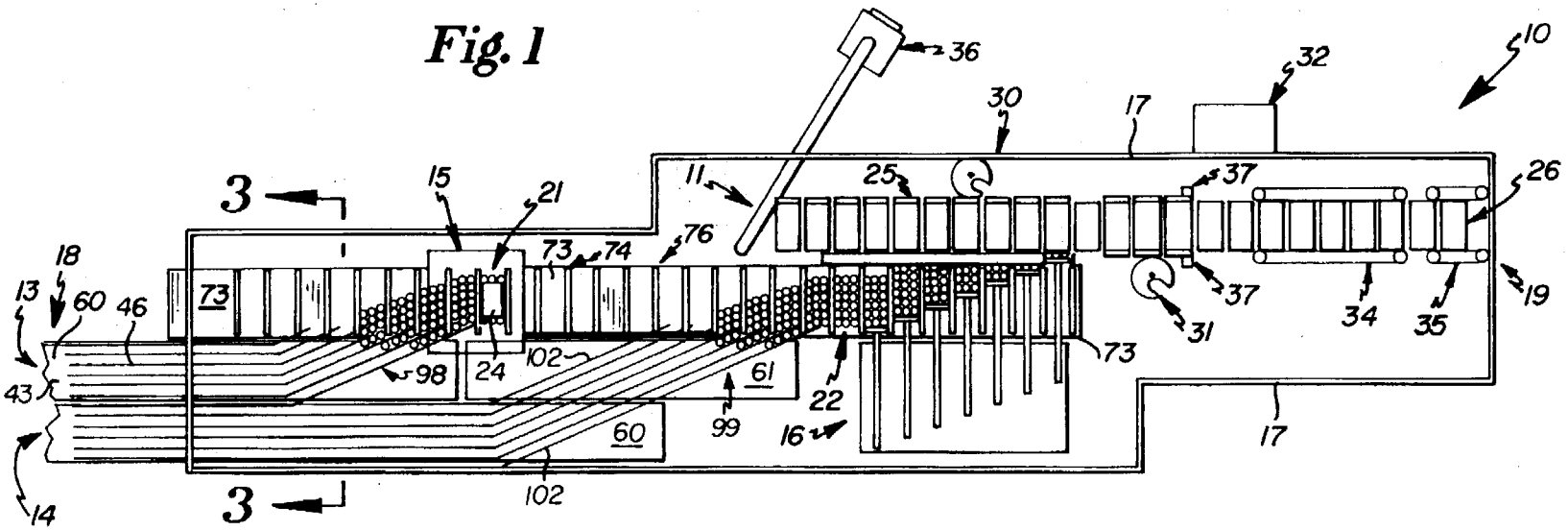
FIG. 2 is a top plan view of the cartoner assembly.
Figure 11:
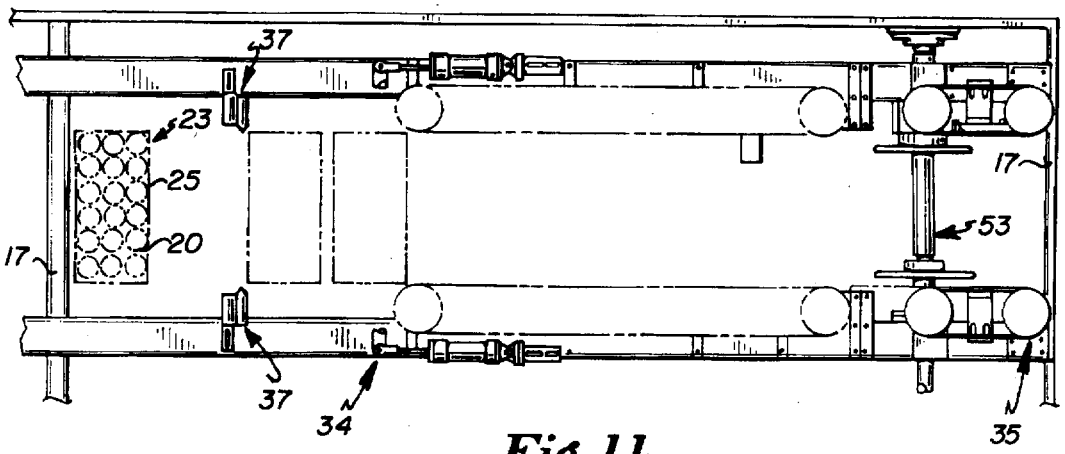
FIG. 11 is a top view of the discharge end of the carton supply and transport mechanism.

Referring to FIGS. 1 and 2, the continuous motion cartoner assembly 10 generally comprises a carton supply and transport mechanism or stream 11, an article group selection and transport mechanism or stream 12, a pair of article supply mechanisms or streams 13 and 14, a divider placement mechanism 15, and an article group transfer or cross loading mechanism 16. These mechanisms are shown to be supported by a unitary frame structure 17, although if aligned properly, separate support structures may be utilized consistent with the teachings of this invention.

The carton supply mechanism 11 is shown to be disposed proximate an input end 18 of the assembly 10. Carton sleeves or blanks 25 are subsequently transported in a linear fashion to an output end 21 of the apparatus 10. The article supply mechanisms 13 and 14 are also shown to be disposed at the input end 20 of the apparatus 10. A first portion of each article supply mechanism 13 and 14 is disposed spacially parallel to the article group selection and transport mechanism 12, and a second portion merges, at a predetermined angle, with the article group selection transport mechanism 12 to supply streams of product or articles 20 to two separate positions along the article group selection and transport mechanism 12. These merging mechanisms 12–14 are further constructed and arranged to meter individual articles 20, via a fixed flight bar arrangement, into predetermined stacked article groups 21 and 22 on the mechanism 12. The stacking function of the device 10 is accomplished by forming a first group 21 at a low level, placing a separator or divider sheet 24 on the lower group 21 via the divider sheet placement mechanism 15, and then simultaneously forming a second group 22 downstream at a higher level and allowing the upper group 22 to slide across the divider sheet 24 by the action the flight bars of the article group selecting mechanism 12. The article group selection and transport mechanism 12 is disposed adjacent and parallel to the carton supply and transport mechanism 11 and extends downstream, in a linear orientation. Merged or combined article groups 23 are transported downstream thereon in a spaced and metered fashion, each group 23 being aligned with a carton 25 traveling on the carton supply and transport mechanism 11. The crossloading mechanism 16 is disposed adjacent to and parallel with the second portion of the article group selection and transport mechanism 12, extending and traveling longitudinally with respect to the apparatus 10. The crossloading mechanism 16 has a plurality of loading arms which extend transversely or perpendicularly with respect to the transport mechanisms 11, 13 add 14, to move product groups 23 on the article group selection transport mechanism 12 into aligned cartons 25 traveling on the carton transport mechanism 11, thereby loading the cartons 25 with product groups 23.

Preferably, each of the aforementioned mechanisms 11–14 and 16 has a conveyor type structure with an endless chain or belt configured about rotatable drive and idler end means and moving longitudinally with respect to the input (upstream) and output (downstream) ends 18 and 19 of the apparatus 10. The movement of each mechanism is further synchronized with one another, for example by a common drive and/or gearing means. The synchronized operation of these cooperating mechanisms 12–16 continuously selects and meters streams of individual articles 20 traveling in two input streams into predetermined stacked groups 23 traveling in a second stream, which are subsequently transversely loaded into cartons 25 traveling in a third parallel linear stream.

Figure 3:
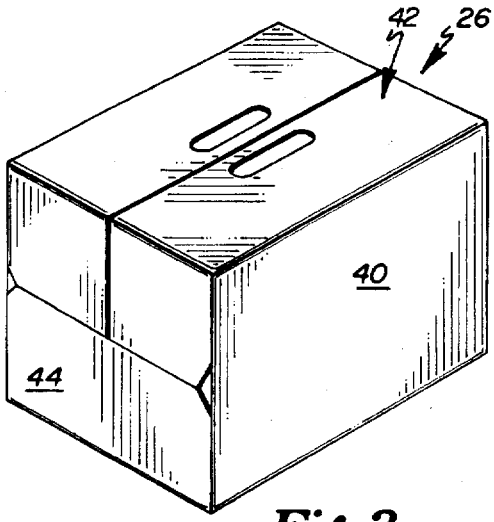
FIG. 3 is a perspective view of a carton assembled by the cartoner assembly.
Figure 4:
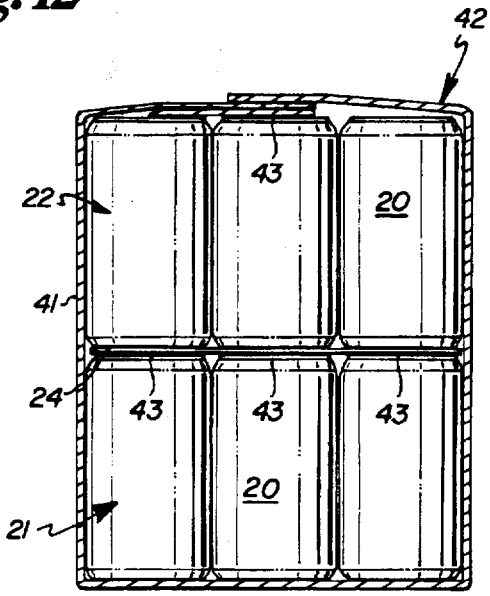
FIG. 4 is a crossectional view of the carton taken along line 4—4 of FIG. 3.

Referring to FIGS. 3 and 4, the cartoner apparatus of this invention constructs carriers or cartons 26 containing stacks of cans 20 or other articles which are disposed on top of one another. The paperboard carrier blank or sleeve 26 is comprised of leading and trailing side panels 40 and 41 foldably connected to top panel 42 and to a bottom panel 43. End panels 44 connect the top, bottom and side panels 40–43. As shown, the carrier 26 contains a bottom layer or sub-group 21 of articles, shown for purpose of illustration as beverage cans 20, and an upper layer or sub-group 22 of cans in stacked relationship. The lower ends of the upper cans 22 are supported on a thin, paperboard divider sheet 24 (also referred to as a base or support sheet) with the bottom cans 21 resting on the bottom panel 43. An extension tab located on the medial edge of the sheet 24, and which folds down via a perforation or scoreline is preferably provided to help stabilize the divider sheet 24. The extension tab provides a means for holding the sheet 24 stable while the upper layer of cans 22 are pushed onto the separator sheet 24. Once the cans 23 have been all properly positioned the sheet 24 is held in place by guides on the apparatus 10. The top panel 42 is disposed closely adjacent, and preferably is in contact with, the top chimes 43 of the upper level 22 of cans to provide for a tight fit between the cans 20 and the carrier 25. Although the apparatus 10 shown in the drawings is utilized in a beverage can cartoning operation with paperboard carrier sleeves, modifications consistent with the teachings of this invention may be made to package various other containers or articles.

Referring also to FIGS. 5, 6, 20 and 22, the carton supply and transport mechanism 11 is preferably a rotary type carton placer 49, such as that disclosed in U.S. Pat. No. 4,530,686 owned by Applicants' assignee. The carton erecting apparatus 49 is supported above the input end of the carton transport mechanism 11 by a vertically adjustable frame structure 50, and basically transfers flat carton blanks or sleeves 25 from a power magazine 51 to the conveyance surface of the mechanism 11, simultaneously opening the blank 25 so that it assumes a four-sided configuration with opposing open ends bounded by at least one flap 44 each. Importantly, the partially erected carton 25 is placed in a transverse or lateral orientation so that its ends are open to the sides of the carton transport mechanism 11 for loading purposes.

The carton transport conveyor 52 receives cartons 25 from the carton supply placer 49 and transports them linearly downstream with respect to the overall apparatus 10. The downstream transport of cartons 25 is synchronized with the article group selection and transport mechanism 12 and with the crossloading mechanism 16, as described further below, to effectuate carton 25 loading. Importantly, the carton transport conveyor 52 is adjustable to accommodate cartons 25 of varying types and sizes. Referring also to FIGS. 9, 10 and 22–25 in particular, the carton transport conveyor 52 basically comprises a plurality of flight lugs 56 which are connected to a pair of flight chains 181 and 182, the flight chains 181 and 182 being connected to and revolving about drive and idler ends 53 and 54. Although a pair of lugs 56 is shown, the number of lugs 56 per carton 25 may be varied for alternative carton configurations. The lugs 56 are shown to serve a dual purpose in that they are disposed anterior with respect to a particular carton 25 for control and stabilization purposes, while the pair 56 which is disposed posterior to the carton urges the carton 25 forward on the conveyor mechanism 52. The lugs 56 are preferably constructed of nylon or a similar material. The lugs 56 are attached to the flight chains 181 and 182 via lug bases. The flight chains 181 and 182 are supported at the top or forward run of the conveyor 52 by chain guides 183. The chain guides 183 are connected to the main frame 17 via guide supports 184. An elongated, longitudinally extending return guide 185 is disposed along the bottom run of the conveyor 52 and mates with a notch in each lug 56 to stabilize their return during high speed operation. Additionally, a longitudinally oriented slide rail (not shown) may be disposed between the flight chains 181 and 182, level with the horizontal plane of the chain guides 183, and with a low-friction top surface to support the bottom of each carton 25 on the conveyor 52. The width-wise or transverse spacing between lugs 56 on the parallel, side-by-side chains is preferably variable via a transverse lug adjustment mechanism. Although a single pair of flight lugs 56 is shown, an alternative structure may be constructed with phase adjustable leading and trailing flight lugs, as is known in the art. This phase adjustment is desirable to permit the apparatus 10 to be used with various carton configurations to allow for adjustment of carton spacing between, for example, 6 and 12 inch, on center arrangements to convert the apparatus 10 from 6 to 36 pack processing.

Referring to FIGS. 5, 10 and 14–17, the apparatus preferably includes a carton stabilization structure 28 which supports the tops of the relatively tall, bi-level cartons 25 traveling on the carton supply and transport mechanism 11, particularly during the loading phase of operation. The carton stabilization structure 28 basically comprises a pair of overhead rails 191 and 192 connected to vertical and horizontal support members 193 and 194 which are linked via adjustment mechanism 195 supported by posts 196. A carton sleeve set up guide assembly 197 is also preferably disposed anterior to the carton stabilizer 28 and immediately downstream of the point of initial placement of the sleeve on the conveyor 52 by placer 49.

Figure 5:
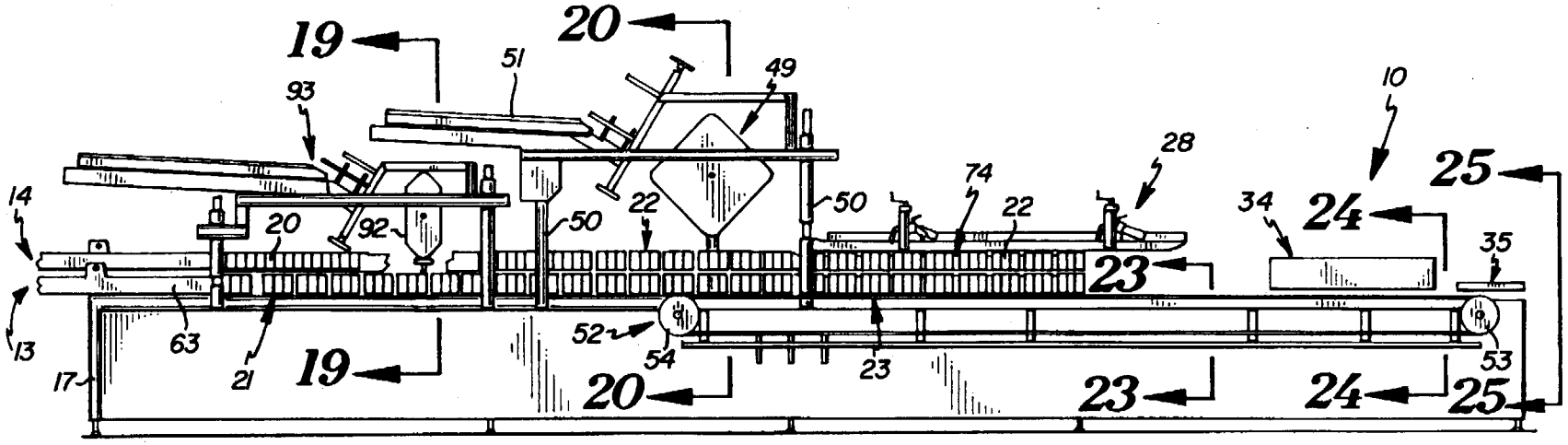
FIG. 5 is a detailed side view of the cartoner assembly.
Figure 6:
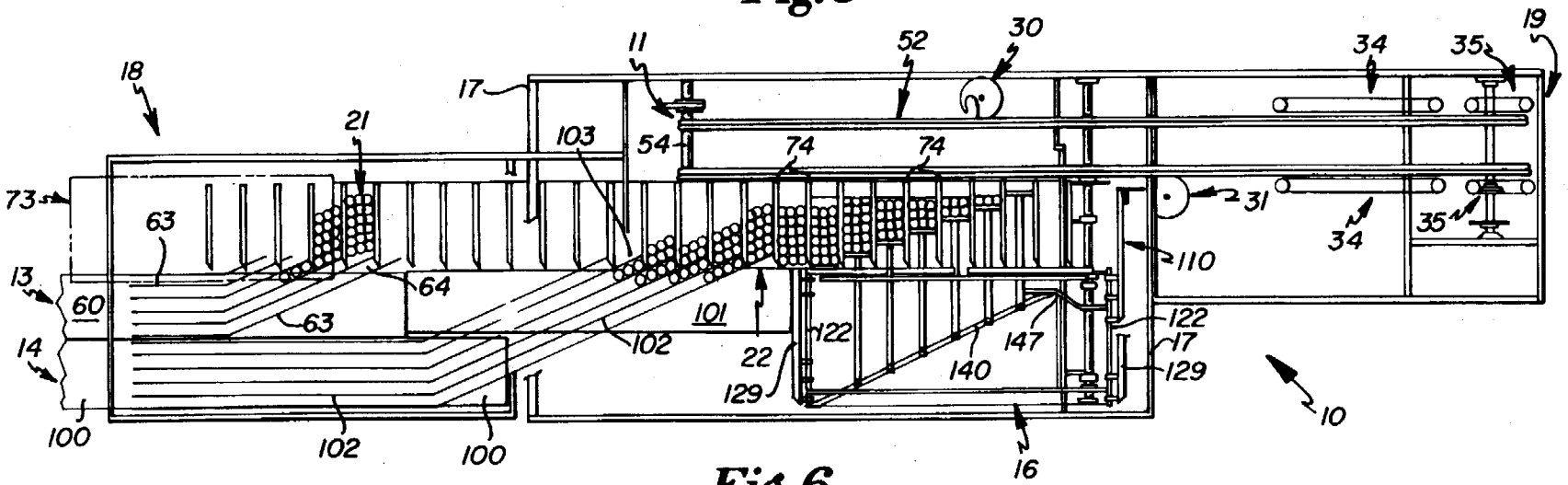
FIG. 6 is a detailed top plan view of the cartoner assembly.
Figure 13:
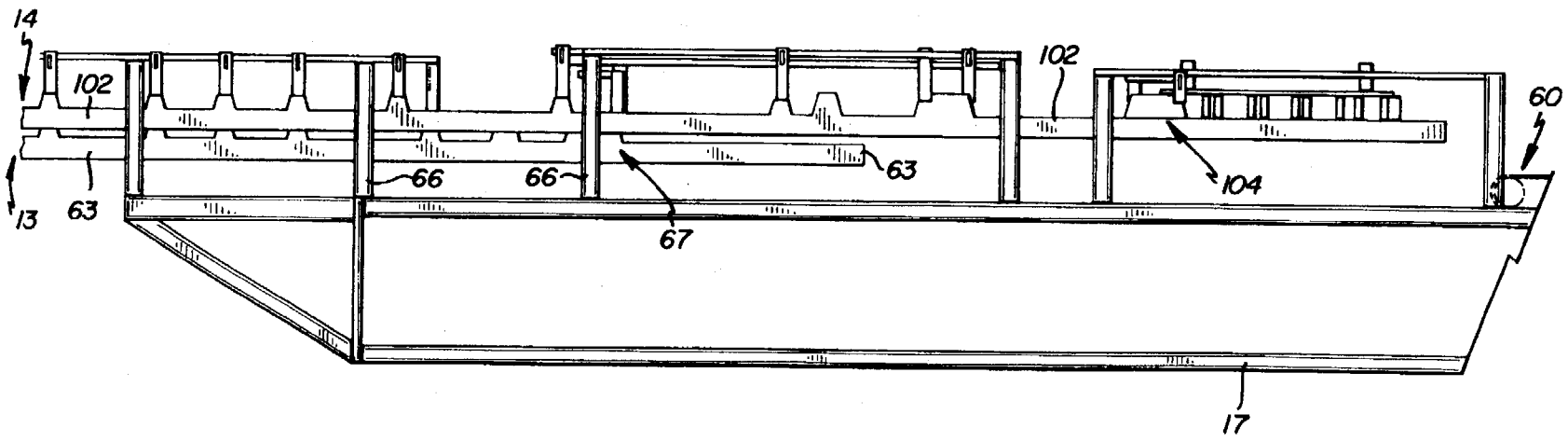
FIG. 13 is a side view of the infeed guides of the article supply mechanisms.
Figure 14:
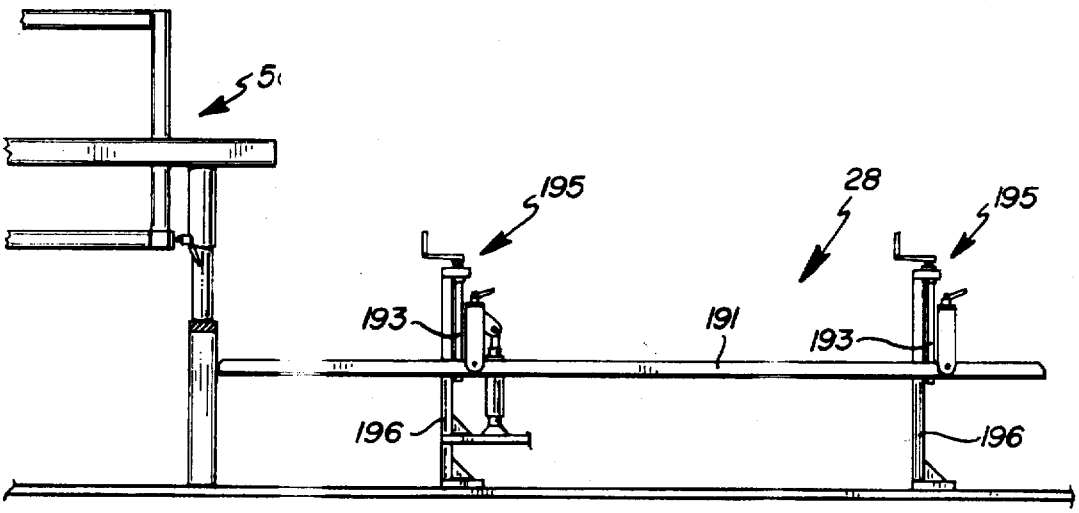
FIG. 14 is a side view of the carton support assembly of the carton supply and transport mechanism.
Figure 15:
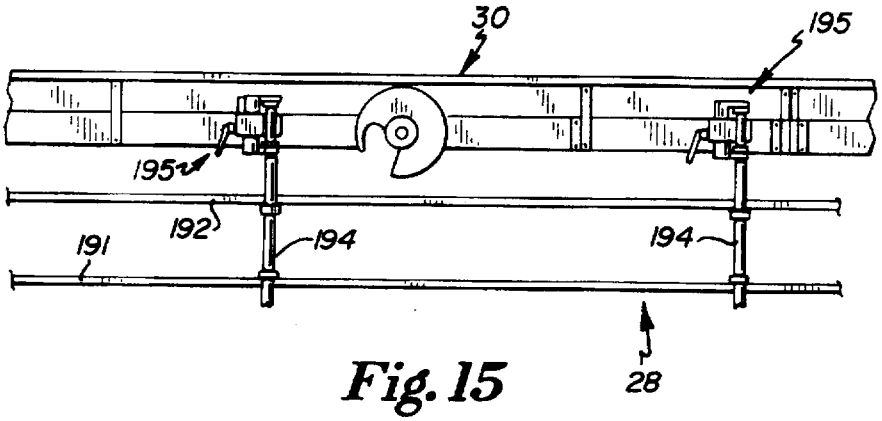
FIG. 15 is a top view of the carton support assembly of FIG. 14.
Figure 16:
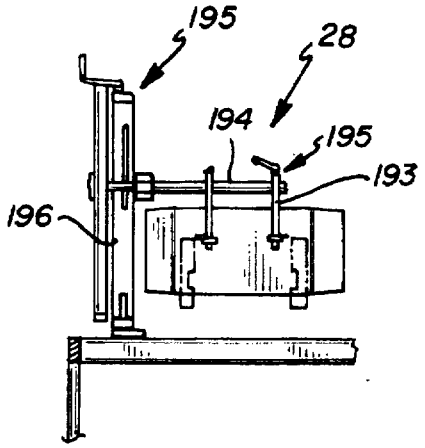
FIG. 16 is a left end view of the carton support assembly of FIG. 14.
Figure 17:
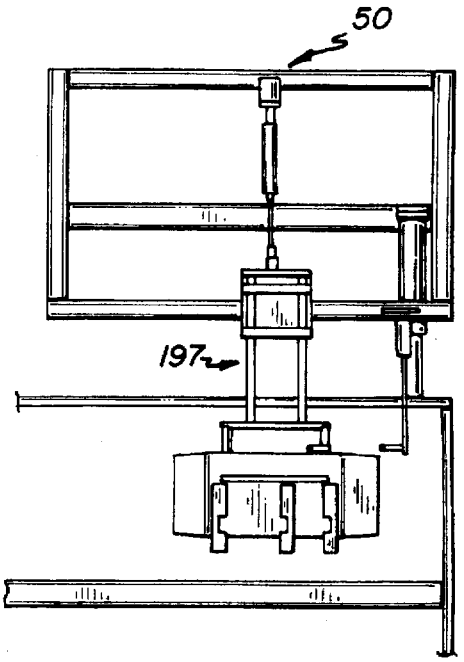
FIG. 17 is a right end view of the carton support assembly of FIG. 14.
Figure 23:
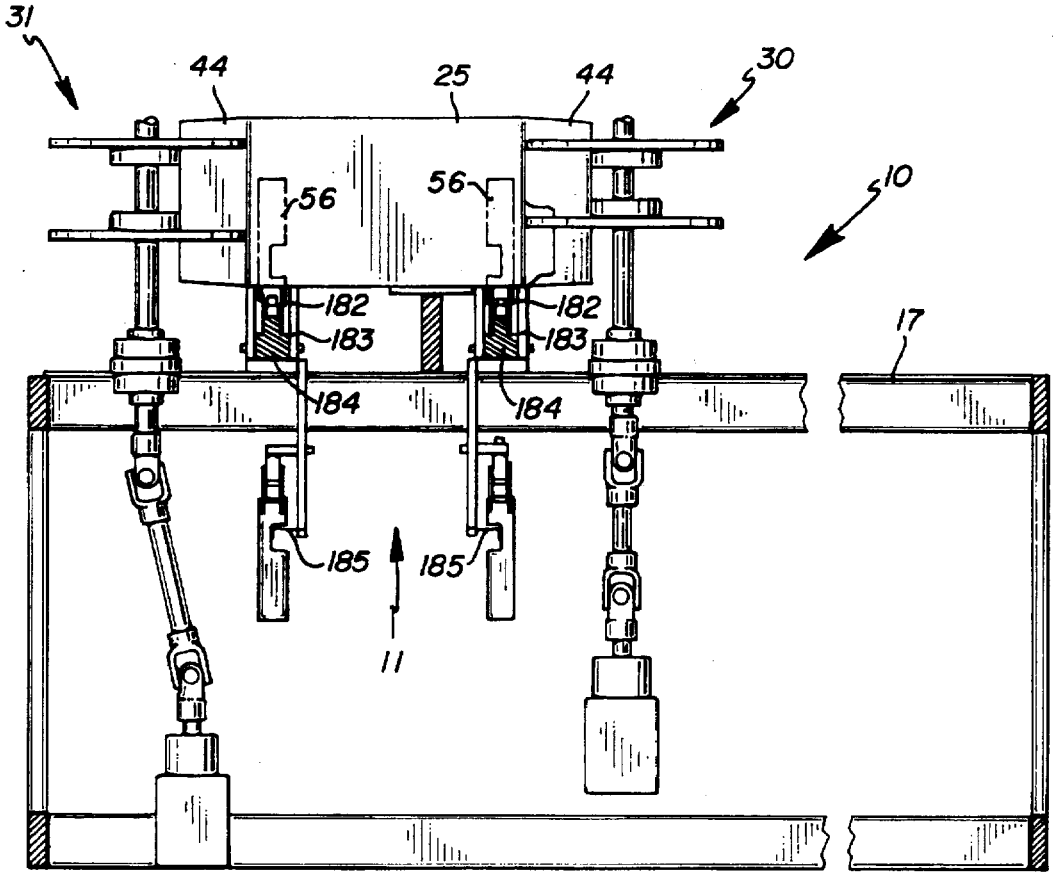
FIG. 23 is a crossectional view of the cartoner apparatus taken approximately along line 23–23 of FIG. 5.
Figure 18:
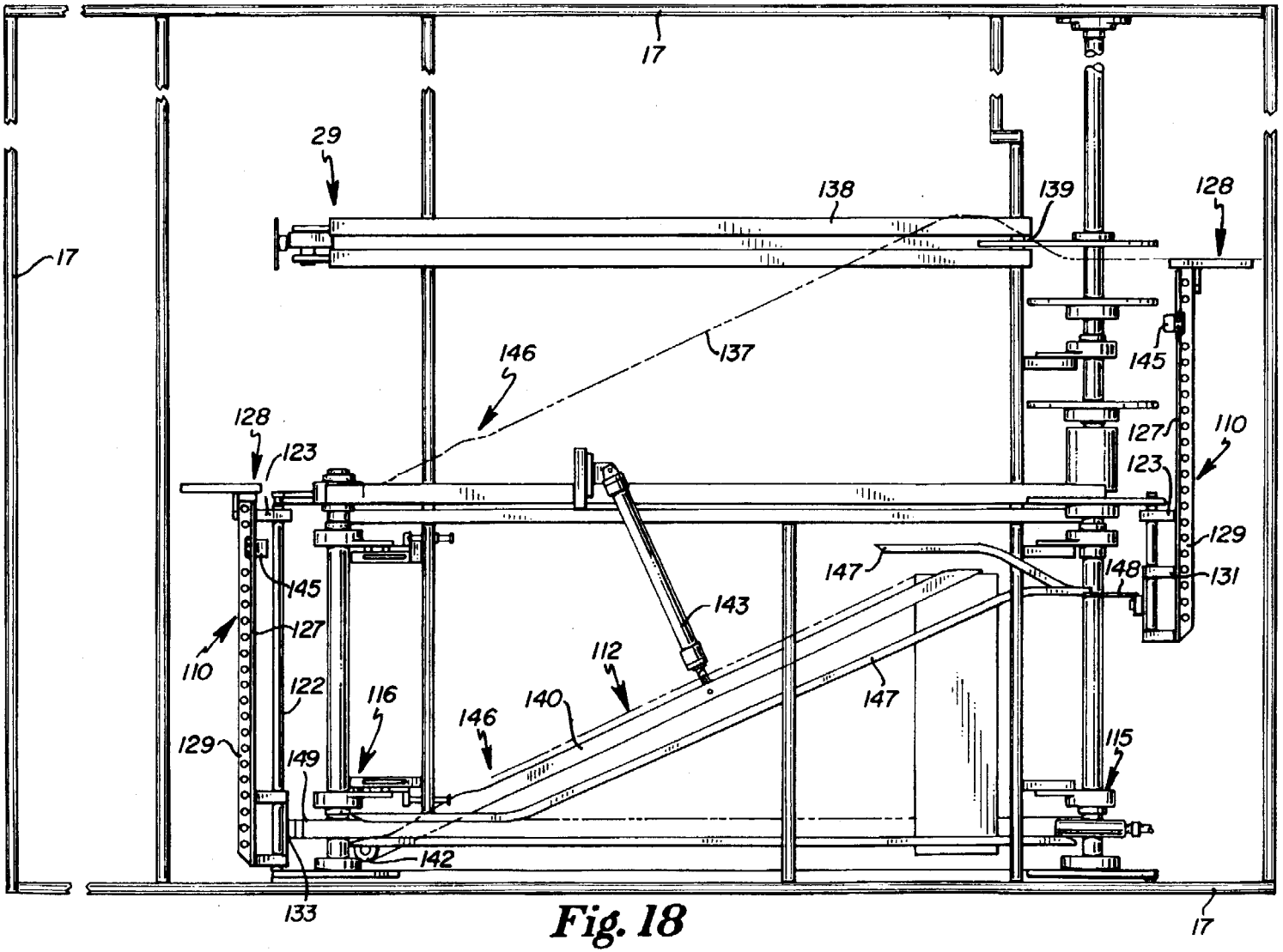
FIG. 18 is a top view of the crossloading mechanism.

Referring to FIGS. 5, 6 and 13, the first or low article supply mechanism 13 provides a plurality of input individual articles 20 to the apparatus 10 at a first predetermined level or height and at a predetermined point on the article group selection and transport mechanism 12. The mechanism 13 is shown to comprise a conveyor 60 disposed about a drive sprocket/shaft assembly 61 and an idler sprocket/shaft assembly 62. The conveyor 60 preferably consists of a unitary, belt. Articles 20 transported on the top, forward run of the conveyor 60 are separated into a plurality of single file paths by lane separators 63. Each lane separator 63 is shown to be an upstanding plate of a height sufficient to guide the flow of one or more containers 20 on the conveyor 60, and which is suspended above the conveyor 60. The lane separators 63 form product conveyance lanes which angle towards the article group selection and conveyance mechanism 12. An approach angle of approximately 20–25 degrees with respect to the longitudinal axis of the mechanism 12 has been found to provide optimal product group selection results. The conveyor 60 is disposed parallel with and immediately proximate to the article group selection and transport conveyor 12 to allow for article movement therein between. A low friction, dead plate having angled lane grooves which correspond with the lane separators 63 is preferably interposed at the interface between the conveyor 60 and the transport mechanism 12. Each lane separator 63 has a terminal portion 64 of a predetermined length, such that it extends into the path of the article group selection and transport mechanism 12 a distance approximately equal to one-third the width of the mechanism 12 conveyance path. Each terminal portion 64 is constructed such that it allows longitudinally transported flight structures 74 (described further below) of the article group selection and transport mechanism 12 to pass through the angled conveyance lanes. As the flight bars 74 mesh with and pass through the lane separator end portions 64, they engage articles 20 disposed in lanes and rake them onto the longitudinal conveyance path of the mechanism 12 and between adjacent flight bars 74.

The combination of forces exerted by the flight bars 74, lane ends 64, and conveyors 60 and 12 serve to select and meter individual articles 20 into predetermined article groups 21 which are fully merged onto the article group selection and transport mechanism 12. The size, orientation and dimesions of the resultant product groups 21 is dependent upon the number of infeed lanes, product dimensions, and the configuration and spacing of the flight bars 74. For example, in the instant embodiment, six (6) lanes of product are active, and the flight bars 74 are spaced such that the resultant product group 21 is selected of eighteen (18)

articles in three rows of six cans each. Lanes may be blocked off by closure means 67 to alter the group 21 size and/or orientation. The lane separators 63 and the flight bars 74 are adjustable to provide full variability of product group parameters.

The low article supply mechanism 13 is shown to terminate at its infeed end 18 for mating with a complementary external apparatus, for example an additional infeed conveyor or conveyors. Alternatively, such infeed conveyor may be integrated with the apparatus 10. Further, although this embodiment utilizes conveyance lanes which are initially oriented parallel with the remaining elements of the apparatus 10 and subsequently angle towards the article group selection transport mechanism 12, it is possible to provide an infeed conveyor that is entirely angled as such.

Figure 7:
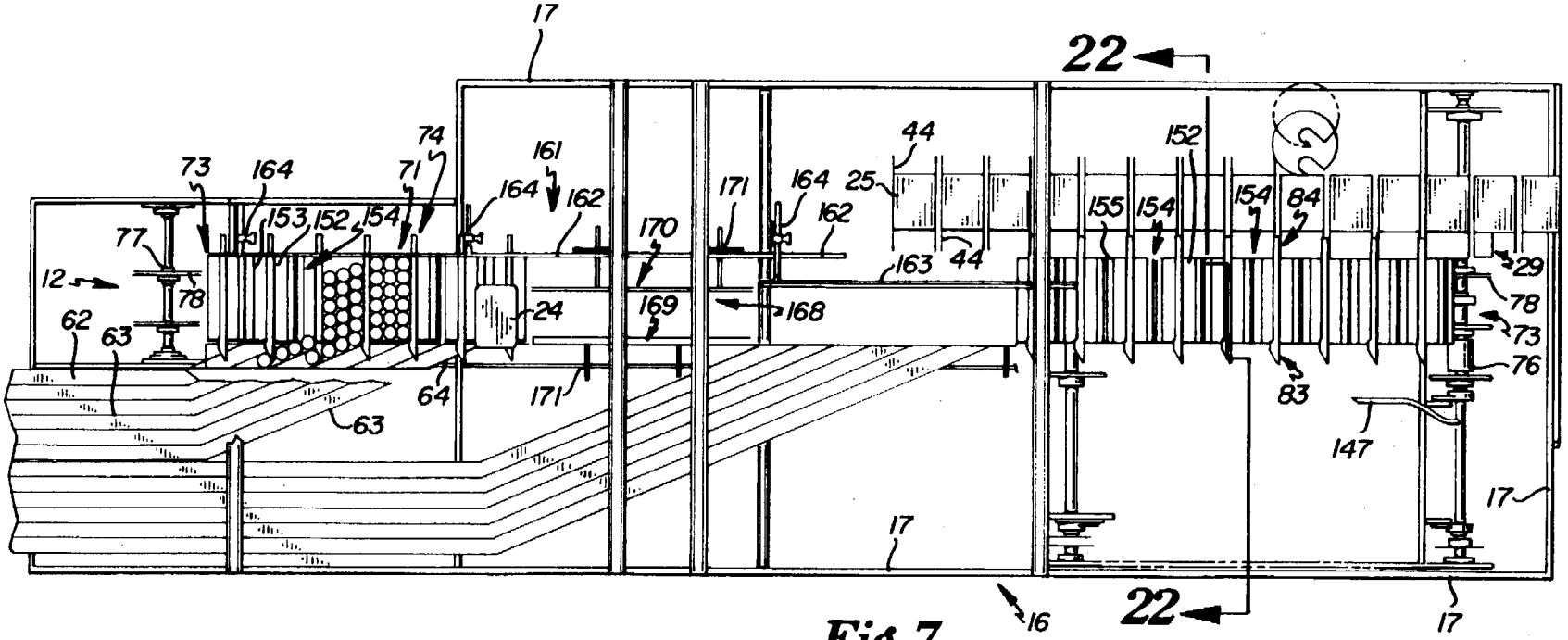
FIG. 7 is a top plan view of a portion of the cartoner assembly.
Figure 21:
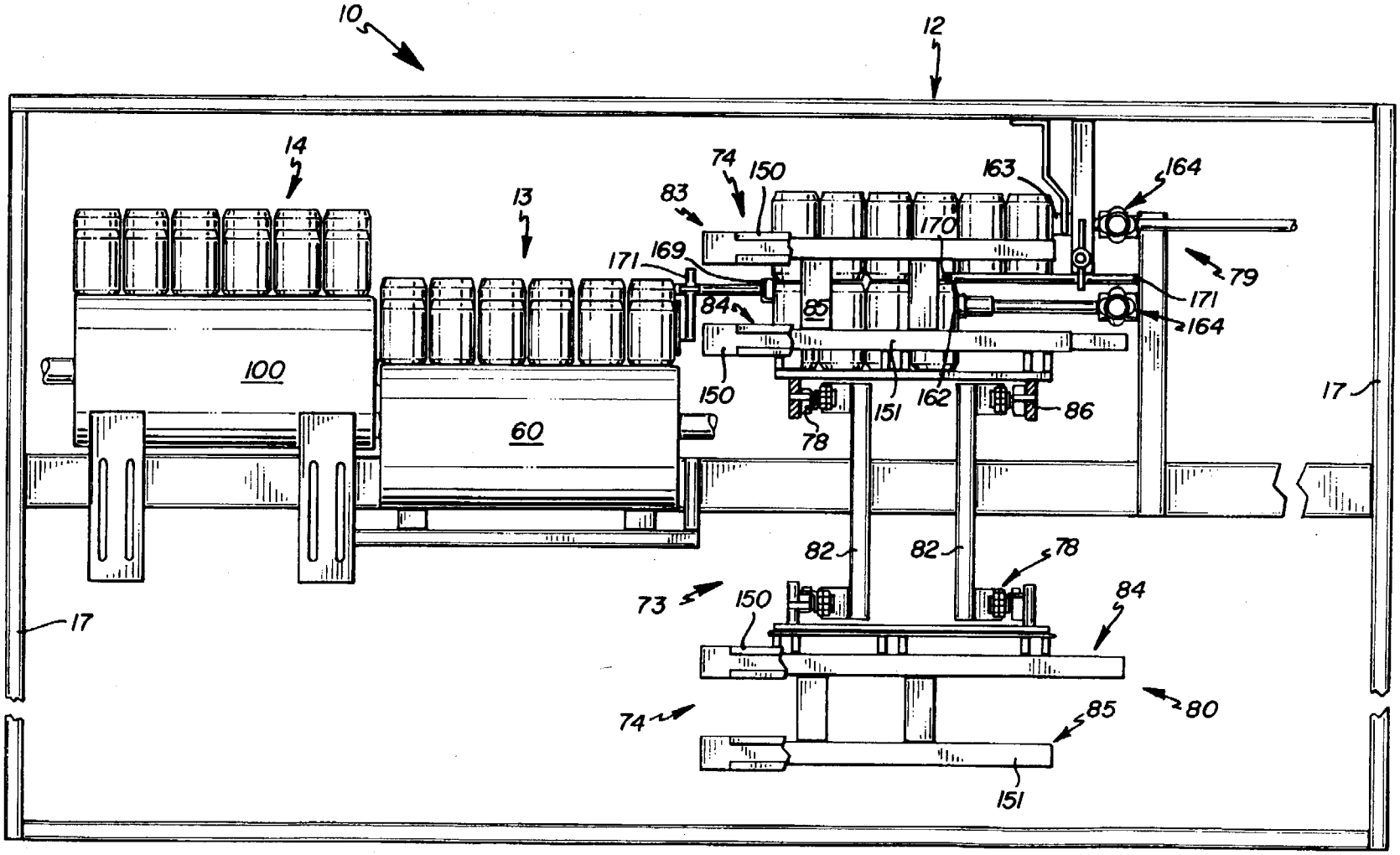
FIG. 21 is a crossectional view of the cartoner apparatus showing details of the article group selection and transport mechanism.
Figure 22:
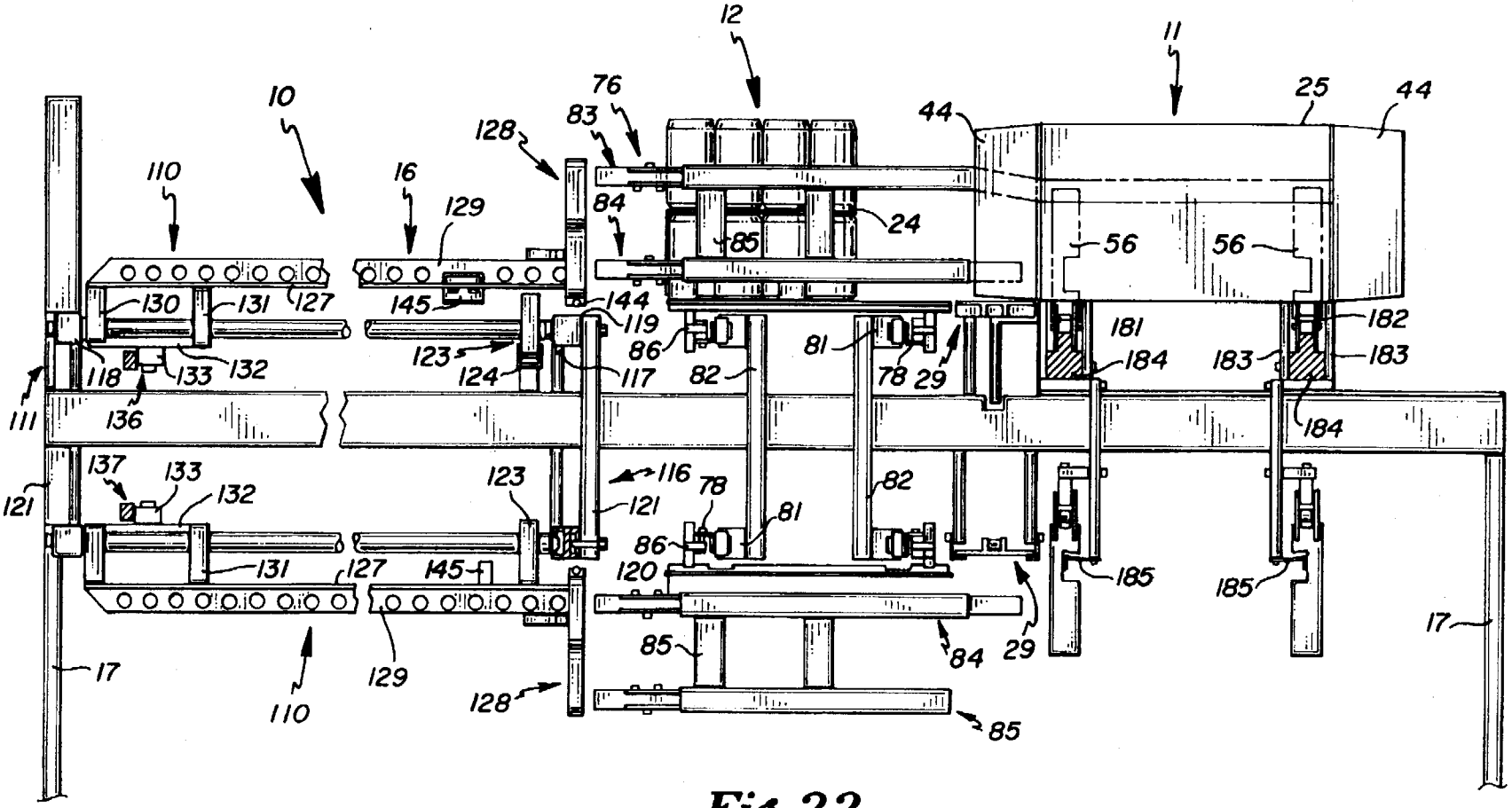
FIG. 22 is a crossectional view of the cartoner apparatus taken along line 22—22 of FIG. 7.
Figure 24:
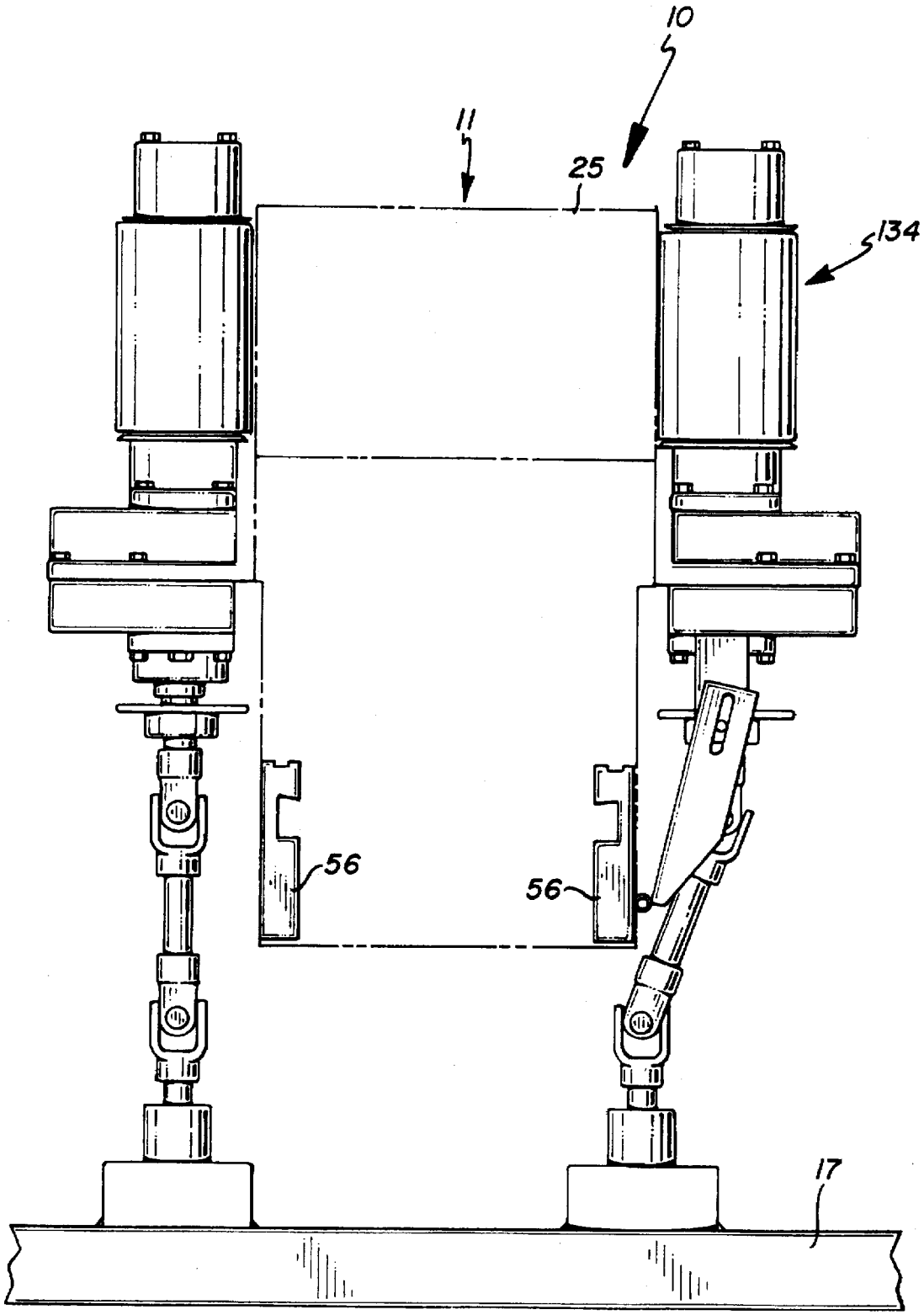
FIG. 24 is a crossectional view of the cartoner apparatus taken approximately along line 24—24 of FIG. 5.
Figure 25:
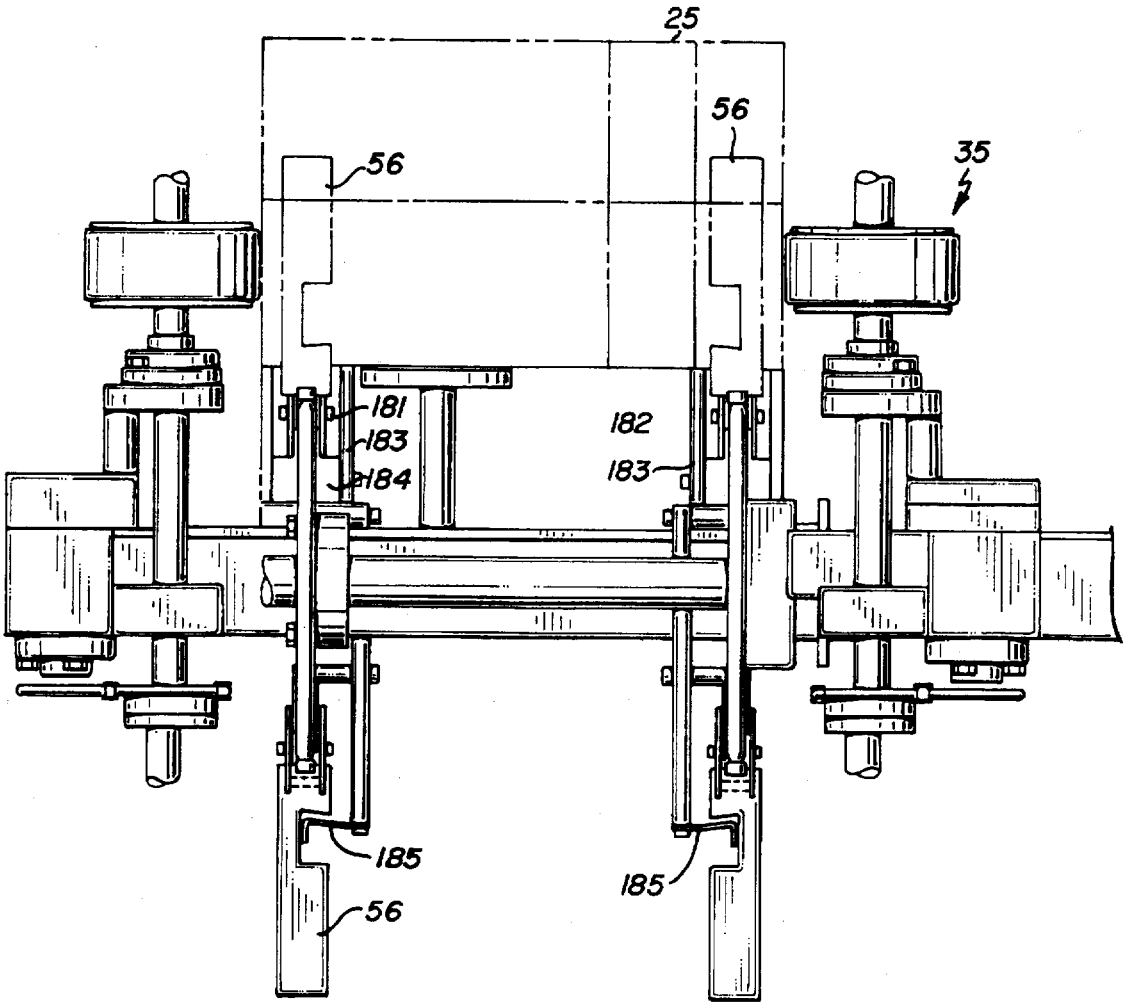
FIG. 25 is a crossectional view of the cartoner apparatus taken approximately along line 25–25 of FIG. 5.
Figure 26:
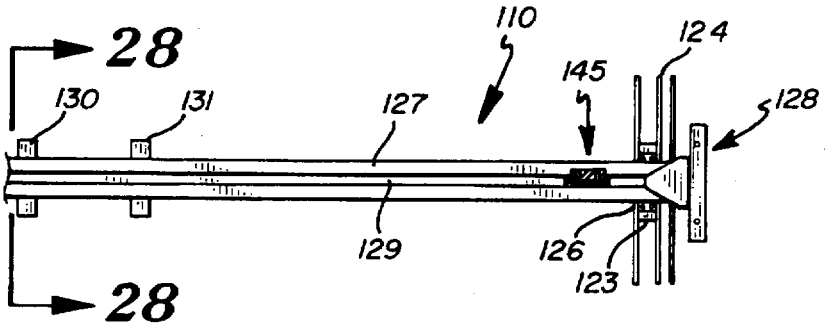
FIG. 26 is a top view of a loader arm assembly.
Figure 27A:
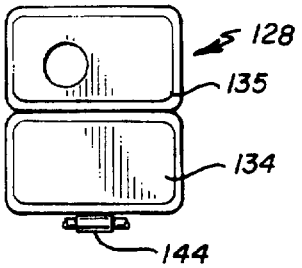
FIG. 27*a* and FIG. 27*b* are side and end views of a pushing face.
Figure 27B:
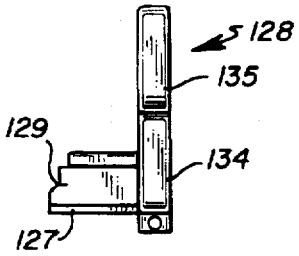
Figure 30:
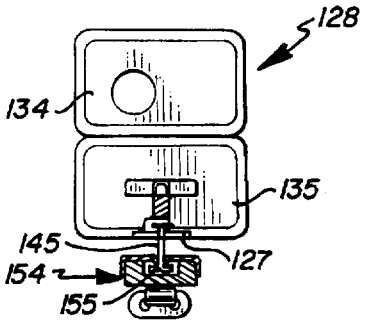
FIG. 30 is a crossectional view of a loader arm assembly operatively extended across the article group selection and transport mechanism.
Figure 28:
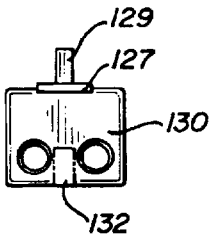
FIG. 28 is an end view of the loader arm assembly taken along line 28—28 of FIG. 26.

The article group selection and transport mechanism 12 selects article groups 21 and 22 from the first or low article supply mechanism 13 as set forth above and from the second or high article supply mechanism 19 discussed below, and transports them linearly downstream with respect to the overall apparatus 10. The downstream transport of article groups 21 and 22 is synchronized with the carton supply and transport mechanism 11 and with the crossloading mechanism 16, as described further below, to effectuate carton 25 loading. Referring also to FIGS. 7, 21 and 22, the article group selection and transport mechanism 12 generally comprises a conveyor 73, a plurality of flight bar assemblies 74 fixed to and longitudinally transported on the conveyor 73, and a plurality of slide plates 75, which are disposed on the conveyor 73 between the spaced flight bars 74.

The conveyor 73 runs at a predetermined speed and includes a drive sprocket/shaft assembly 76 and an idler sprocket/shaft assembly 77, a pair of parallel endless conveyor chains 78 which are connected to and revolve about the sprocket/shaft assemblies 76 and 77, forming a longitudinally extending forward or top run 79 and a return or bottom run 80. Idler assembly 77 is disposed just anterior to the area where the first or low article supply mechanism 13 merges with the article group selection and transport mechanism 12, and marks the beginning of the conveyor 73. The drive sprocket/shaft assembly 76 is disposed adjacent the end of the crossloading mechanism 16 and marks the end of the conveyor 73. The conveyor chains 78 are each supported by top and bottom longitudinally extending chain guides 81, which in turn are connected to the main frame 17 via upstanding conveyor supports 82.

Figure 31:
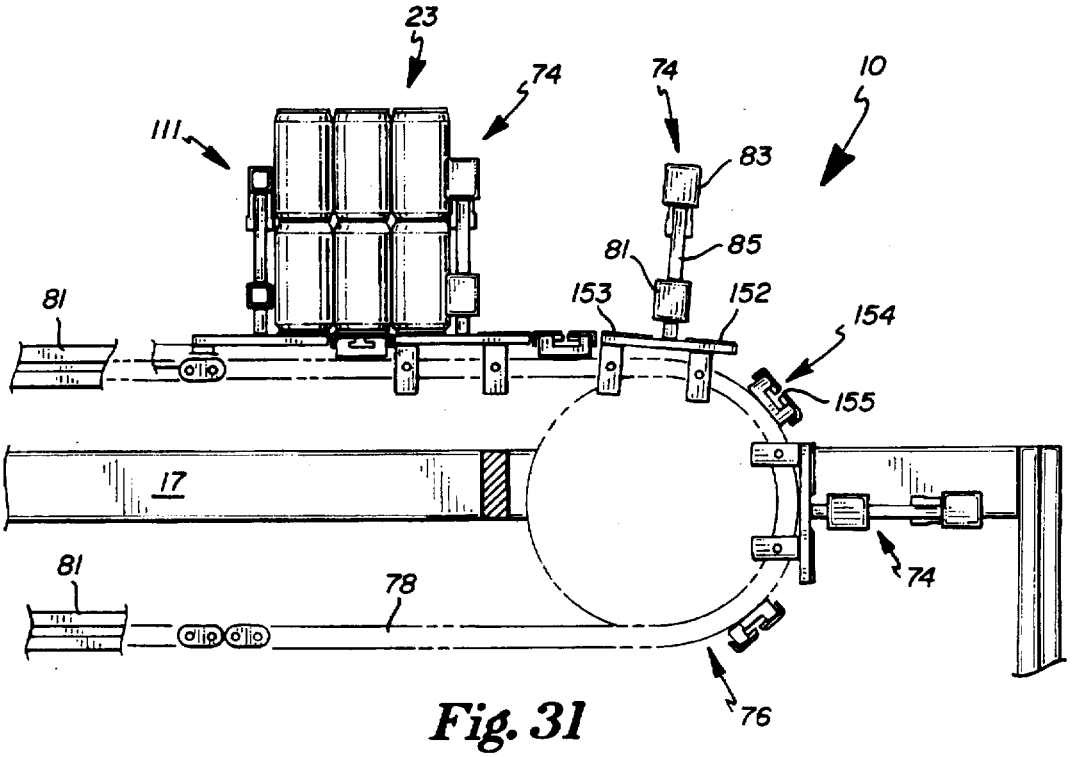
FIG. 31 is a detailed side view of the flight bar structures of the article group selection and transport mechanism.

Referring also to FIG. 31, the flight bar assemblies 74 are each shown to include a top rail member 83 and a bottom rail member 84 which are connected to one another by vertical spacers 85. The top and bottom members 83 and 84 are shown disposed parallel to one another and spacially separated by the spacers 85. Each top and bottom member 83 and 84 further has an angled front end 150 and an elongated, rectilinear body 151 terminating in a flat back end. The front end 150 slants or angles inwardly from its leading edge to its trailing edge to enable the flight bars 74 to select individual articles 20 disposed in the article infeed lanes and to separate them from the closely spaced nearest upstream article 20. As is best shown in FIG. 7, a pair of fixed slide plates 152 and 153 are connected to each flight bar 74 assembly. Both the flight bars 74 and the slide plates 152 and 153 are connected to the flight chains 78 via connection brackets 86. The slide plates 152 and 153 are thin, flat structures with a low friction top surface which support the lower article groups 21 and further permit sliding movement thereon. Additionally, slotted slide plates 154 are disposed between adjacent flight bar assemblies 74, each plate 154 including a laterally oriented slot 155.

The height of the flight bar 74 (i.e., the separation distance between the top and bottom members 83 and 84) is a function of the container and container group size and configuration. For example, taller cans (12 oz.) require greater flight bar 74 height than a short can (10 oz.), for proper selection and transport. The width of the top and bottom members 83 and 84 is a function of the desired dimensions of the product groups 21 and 22 formed. It is within the purview of this invention that the flight bar 74 height and width be fully adjustable to accommodate various container and group parameters.

Figure 8:
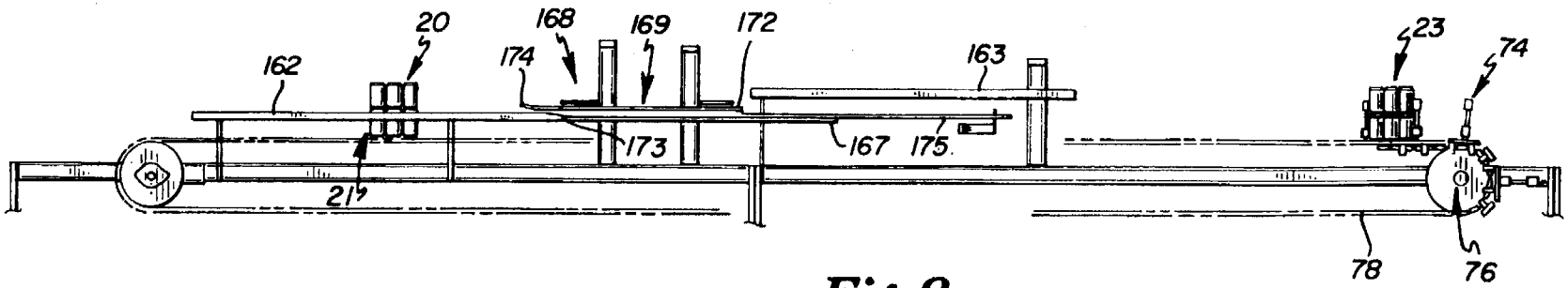
FIG. 8 is a side view of selected portions of the article group selection and transport mechanism.
Figure 9:
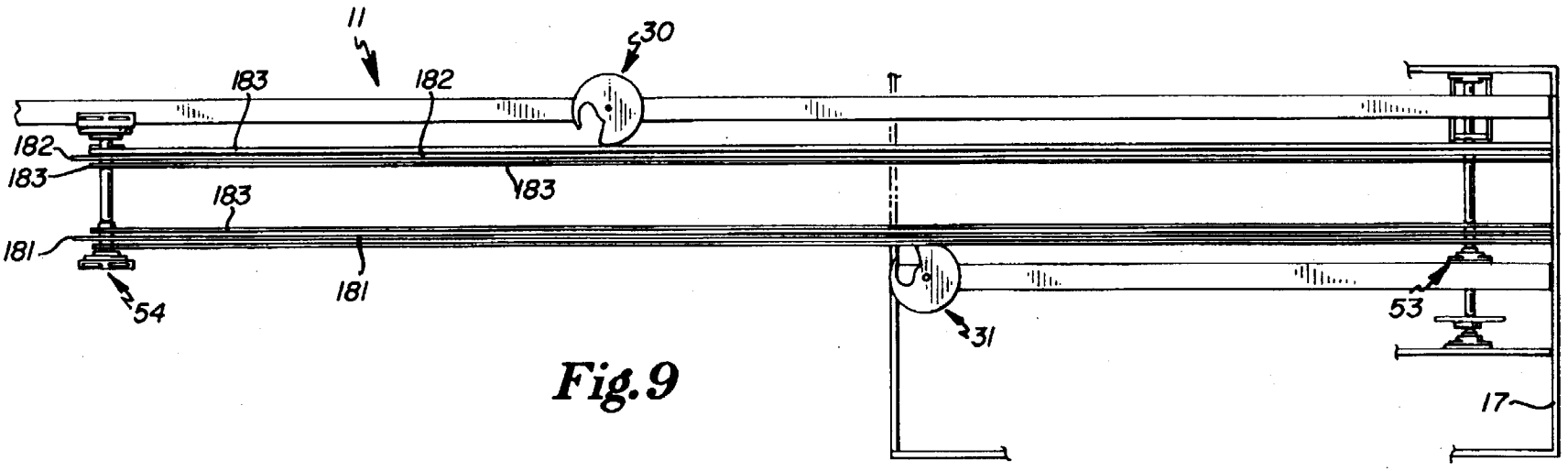
FIG. 9 is a top view of a portion of the carton supply and transport mechanism.
Figure 10:
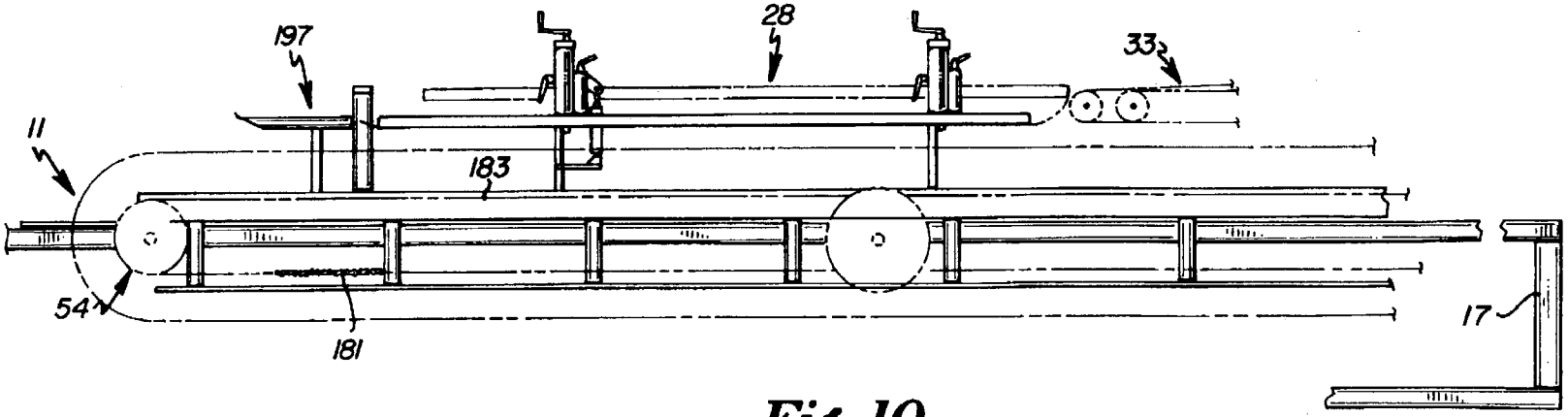
FIG. 10 is a side view of a portion of the carton supply and transport mechanism.

As is best shown in FIGS. 7, 8 and 21, an article group stabilization structure 161 including a pair of longitudinally oriented upper and lower guide rails 162 and 163, and lateral adjustment structures 163 is disposed on the outer or lateral side of the article group selection and transport mechanism 12. The lower guide rail 162 extends from the upstream end of the mechanism 12 to a point anterior to a point on the mechanism 12 at which the upper group 22 is formed. The upper guide rail 162 extends throughout the region on the article group selection and transport mechanism 12 at which the upper group 22 is formed. The upper and lower rails 162 and 163 are disposed at predetermined vertical levels, between the upper and lower members 83 and 84 of the flight bars 74, to contact the base and upper article subgroups 21 and 22 respectively. The lateral extension distance of the rails 162 and 163 is adjustable by means of the lateral adjustment structures 164 to stabilize and horizontally support the article groups 21 and 22 in their merged positions between the flight bars 74.

Figure 19:
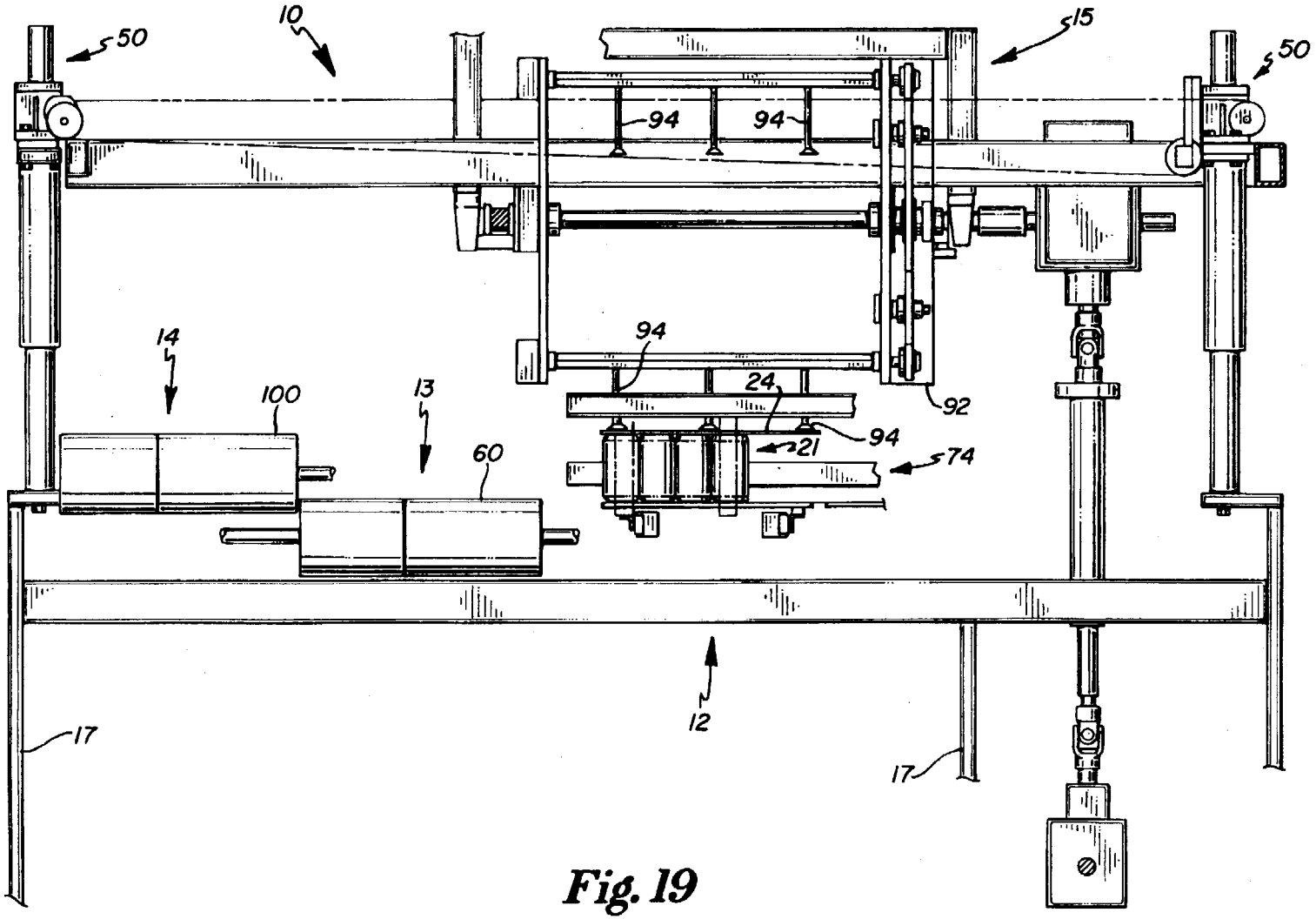
FIG. 19 is a crossectional view of the cartoner apparatus taken approximately along line 19—19 of FIG.
Figure 20:
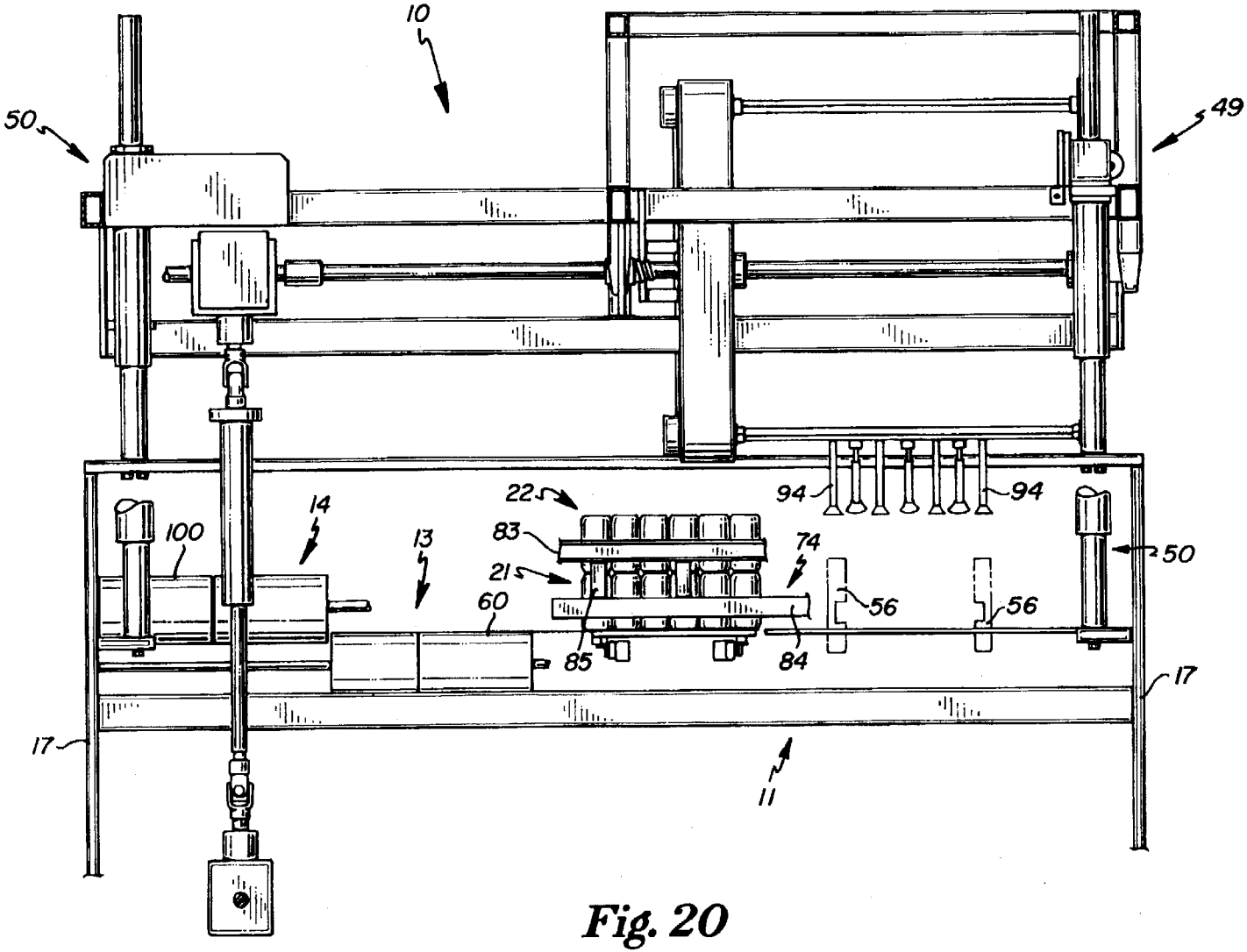
FIG. 20 is a crossectional view of the cartoner apparatus taken approximately along line 20—20 of FIG. 5.

Referring to FIGS. 5 and 19 the divider placement mechanism 15 deposits a divider sheet 24 on the top surface of lower or base article group 21 formed and traveling on the article group selection and transport mechanism 12. The divider placement mechanism 15 is shown to be disposed above the article group selection and transport mechanism 12 at a predetermined point downstream from where the base article group 21 is first fully formed. The divider placement mechanism 15 preferably comprises a rotary placer mechanism 92 of the type manufactured and sold by Applicants' assignee and having a pair of apex positions with vacuum control members 94. A power magazine 93 is shown operatively connected to the placer 92 to provide a continuous supply of divider sheets 24 thereto.

Referring again to FIGS. 7, 8 and 21, a divider hold down assembly 168 including a pair of medial and lateral rails 169 and 170 and adjustment structures 171 is disposed above a segment of the article group selection and transport mechanism 12, extending downstream from a point immediately posterior to the point of placement of the divider sheet 24 by the placer 92. The medial rail 169 has a anterior segment which includes a top member 169 with an upturned forward lip 174 and a side member 173 with a plow configuration, and a rail shaped posterior segment 175. This configuration is designed to engage and fold down the medial flap on the divider sheet 24, formed by a perforation or scoreline, and to hold the flap down over the medial edge of the lower article sub-group 21 to stabilize the position of the divider sheet 24 during downstream transport and lateral movement of the upper article sub-group 22 across the divider sheet 24 top surface. The lateral rail 170 extends a predetermined distance downstream to stabilize the lateral edge region of the divider sheet 24 prior to lateral merging of the upper group 22 across the divider sheet 24. The structure of the divider hold down assembly 168 has been shown to yield a substantially flat divider sheet 24 for improved article group 22 merging thereacross, especially in paperboard divider sheets 24 constructed with recycled materials which tend not to lay flat when unstabilized.

Referring again to FIGS. 5, 6 and 13, the second or high article supply mechanism 14 provides a plurality of input individual articles 20 to the apparatus 10 at a second predetermined level or height and at a predetermined point downstream from the low article supply mechanism 13. The mechanism 14 is also shown to comprise a pair of conveyors 100 and 101, each being disposed about a drive sprocket/shaft assembly and an idler sprocket/shaft assembly. The conveyors 100 and 101 may consist of a plurality of individual tracks or paths or alternatively a unitary, wider path or belt. Articles 20 transported on the top, forward run of the conveyors 100 and 101 are separated into a plurality of single file paths by lane separators 102. Each lane separator 102 is shown to be an upstanding wall of a height sufficient to guide the flow of one or more containers 20 on the conveyors 100 and 101, and which is suspended above the conveyors 100 and 101. The lane separators 102 form product conveyance lanes which angle towards the article group selection and conveyance mechanism 12 at an approach angle of approximately 20–25 degrees with respect to the longitudinal axis of the mechanism 12. The conveyors 100 and 101 are disposed parallel with the article group selection and transport conveyor 12. Conveyor 101 is further disposed immediately adjacent the article group selection and transport conveyor 12 to allow for article 20 movement thereinbetween. A dead plate region is also preferably utilized. Each lane separator 102 has a terminal portion 103 of a predetermined length, such that it extends into the path of the article group selection and transport mechanism 12 a predetermined distance. Each terminal portion 103 is constructed such that it allows the longitudinally transported flight structures 74 of the article group selection and transport mechanism 12 to pass through the angled conveyance lanes. As the flight structures 74 mesh with and pass through the lane separator end portions 103, they engage articles 20 disposed in lanes and rake them onto the longitudinal conveyance path of the mechanism 12.

The combination of forces exerted by the flight bars 74, lane ends 103, and conveyors 100, 101 and 73 serve to select and meter individual articles 20 into predetermined upper article groups 22 which are merged onto the divider sheet 24 on top of the lower or base article group 21 traveling on the article group selection and transport mechanism 12. The size, orientation and peripheral dimensions of the resultant upper product groups 22 is dependent upon the number of infeed lanes, product dimensions, and the configuration and spacing of the flight bars 74. The divider sheet 24 provides a low friction base surface upon which the upper group 22 is transversely moved to form a stacked group 23. Lanes may be blocked off by closure means 104 to alter the group 22 size and/or orientation. The lane separators 103 and the flight bars 74 are adjustable to provide full variability of product group parameters.

The article group lateral transfer or crossloading mechanism 16 is synchronized with the aforementioned apparatus 10 elements to move completed, stacked article groups 23 traveling on the article group selection and transport conveyor 12 into aligned cartons 25 traveling on the carton supply and transport conveyor 11. Referring to FIGS. 7, 18, 22 and 26–30, the crossloading mechanism 16 basically comprises a plurality of loader arm assemblies 110, a flight chain and guide tube assembly 111 to which the loader arm assemblies 110 are attached at predetermined intervals, and which provides a longitudinal movement component thereto, and a control cam assembly 112 which provides a predetermined transverse motion component to the loader arm assemblies 110.

The flight chain and guide tube assembly 110 has a forward or top run 113 and a return or bottom run 114 and comprises drive and idler sprocket/shaft assemblies 115 and 116 and a pair of spacially parallel flight chains 117 and 118 which are connected to and revolve about the sprocket/shaft assemblies 115 and 116. The flight chains 117 and 118 are maintained in a rectilinear configuration on both the top and bottom runs 113 and 114 by chain guides 119 and 120, which are linked to the frame 17 via vertical support members 121.

Figure 29:
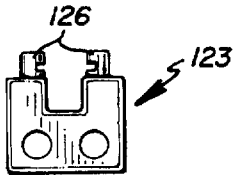
FIG. 29 is an end view of a loader arm guide.

Pairs of elongated guide tubes 122 are disposed at predetermined intervals along the flight chains 117 and 118, each guide tube 122 being directly connected at one end to the outer flight chain 118, and at its opposite end to the inner flight chain 117 so that they are oriented transversely with respect to the axis of the apparatus 10 and to the downstream or forward run of the crossloader 16. The guide tubes 122 have a low friction exterior surface to provide slidable support of the loader arm assemblies 110. The pairs of closely spaced tubes 122 increase the stability of transverse movement of the arm assemblies 110. Further stability is attained by the guide blocks 123 (connected to the inner ends of the guide tubes 122 via set screws) traveling in a longitudinally oriented guide rail 124 which is linked to the frame 17 via a support 125. As best shown in FIG. 29, lateral retainers 126 are mounted on the top of each guide block 123 to guide the transversely moving arm assemblies 110. The spacing between successive sets (pairs) of tubes 122 corresponds to the spacing between the flight bars 74 of the article group selection and transport conveyor 12 and of the flight lugs 56 of the carton transport conveyor 11 so that the arm assemblies 110 are aligned to push product groups 23 from between the flight bars 74 into the cartons 25.

The loader arm assemblies 110 are movably mounted on the guide tubes 122, and in a transverse orientation with respect to the axis of the apparatus 10. The arm assemblies 110 are conveyed in a downstream, longitudinal direction while they simultaneously reciprocate in a transverse direction under the control of a cam mechanism 112 described below. Each loader arm assembly 110 basically comprises an elongated, rectilinear base plate 127 and a loading head 128 located at one end of the base plate 127. The base plate 127 is shown to have a rigid, flat, elongated structure which is oriented horizontally. A rigid stiffing bar 129 is connected to the top surface of the base plate 127, vertically oriented, to increase the rigidity and strength of the arm assembly 110. Preferably, a plurality of bores are disposed in the stiffing bar 129 to reduce its weight. The inwardly disposed end of the base plate 127 is slidably supported by the lateral retainers 126 of the guide block 123. A first or outer bushing block 130 is connected to the bottom of the base plate 127 at its opposite end. The first bushing block 130 has a pair of apertures, including bushings, through which the guide tubes 122 are slidably extended. A second or inner bushing block 131 is similarly connected to the base plate 127 and interfaces with the guide tubes 122 a short distance from the first bushing block 130. The bushing blocks 130 and 131 are further connected by a spreader bar 132 which is oriented and rides in the space between the guide tubes 122. A rotatable cam follower 133 is connected to the bottom of the spreader bar 132. The longitudinally traveling cam follower 133 cooperates with the cam guide assembly 112 to cause the arm assembly 110 elements to transversely reciprocate on the guide tubes 122 and through the lateral retainers 126 of the guide block 123.

The loading head 128 is shown to have two fixed, flat face members 134 and 135. As the arm assemblies 110 move forward, the face members 134 and 135 push the article groups forward from the article group selection transport conveyor 12 into the cartons 25. A support roller 144 is disposed on the bottom of the head 128 to provide support when the head 128 is extended across the article group selection and transport mechanism 12. Additionally, a t-shaped guide pin 145 is disposed on the bottom of the base plate 127 of the arm assembly 110 to mate with the slot 155 in slide plate 154 to laterally stabilize the arm member 110 during high speed operation. The loading head 128 configuration is variable to interface with a wide range of product group 23 configurations. Although in the instant embodiment the head 128 is configured for use with a stacked configuration, the head 128 can be modified for cartoning various other product and product group arrangements, including non-stacked configurations. Head 128 modification is accomplished by changes in the configuration of the face members 134 and 135. A transition conveyor 29, shown in FIGS. 2 and 22, is disposed between the crossloading mechanism 16 and the carton transport mechanism 12 to provide a moving base for the movement of the article groups 23 into the longitudinally conveyed cartons 25. A fixed dead plate may alternatively be used. The bottom member 84 of the flight bars 74 is elongated to extend across the top run of the transition conveyor 29 to guide or funnel article groups 23 across the conveyor 29 and into the cartons 25, between the carton end panels 44.

The loader control cam assembly 112 controls the transverse, reciprocal motion of the arm assemblies 110. The loader control cam assembly 112 is generally oriented longitudinally with respect to the overall crossloading mechanism 16, and has a top or forward run 136 and a bottom or return run 137 corresponding to the revolving arm assemblies 110. The top run 136 basically comprises an inwardly sloping approach segment 137, an apex 138, and an outwardly sloping return segment 139. In the approach segment 137, the cam follower 133 is urged inwardly, and drives each arm assembly 110 into moving engagement with a product group 23 until it is loaded in a carton 25. A lag segment 146 of decreased slope is disposed at a predetermined point where the loading head 128 first contacts the article group 23 to provide gentle, even pressure at this initial contact point. In the return segment 139, the face 128 is retracted from the carton 25 prior to its being reset in the return run 137 of the cam assembly 112. The forward run 136 of the cam assembly 112 comprises an outer rail 140 and an inner rail 141 which is spaced from the inner rail 140 a distance equivalent to the diameter of the cam follower 133. The follower 133 is disposed in a cam pathway formed between the outer and inner rails 140 and 141 to effectuate transverse, inward motion to the arm assemblies 110. Preferably, the outer rail 140 is connected to a pivot point 142 at one end and to a release mechanism, such as a pressure release cylinder and piston 143 proximate its opposite end. The release mechanism 143 is controlled by a sensing mechanism, for example, a photoeye or capacitive proximity sensor, such that if an excessive force is placed on the outer rail 140, for example due to a jamming of the arm assembly 110, the release mechanism 143 will be actuated releasing the outer rail 140 which pivots about point 142.

The bottom or return run 136 of the cam assembly 112 includes circular guide plates 148 and 149, and a bottom cam rail 147 which contacts the cam follower 133 to further retract and reset the loader arms 110 for further loading cycles. Since the loader arms 110 are substantially extended when they revolve around sprocket/shaft assembly 115, it is critical that they be stabilized by the guide pin 145 in slide plate 154 groove 155 during high speed operation.

As shown in FIGS. 2, 6, 7, 9 and 23, lateral and medial flap tuckers 30 and 31 are disposed adjacent each side of the carton transport mechanism 11, one anterior to the loading region to provide a closed carton backside against which the loaded containers may nest, and one posterior to the loading region to allow article group 23 ingress to the carton 25 through its open, unglued end flaps 44.

Figure 12:
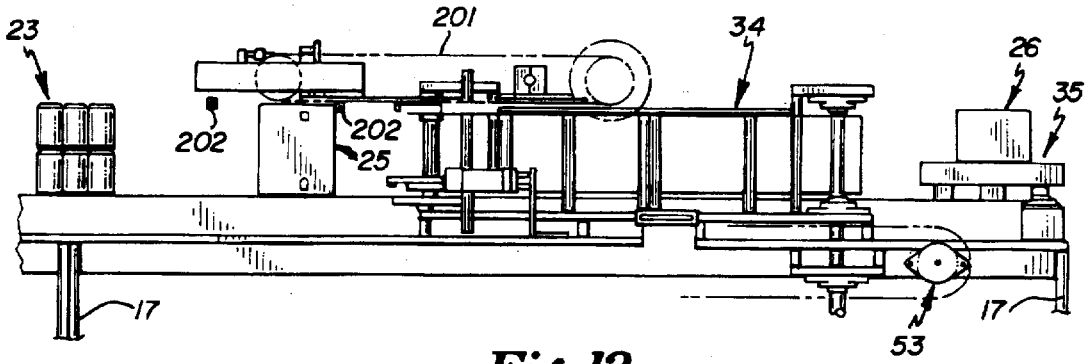
FIG. 12 is a side view of the discharge end of the carton supply and transport mechanism.

Referring to FIGS. 1 and 12, an overhead compression station 33 is shown disposed immediately downstream of glue stations 37, immediately above the carton supply and transport mechanism 12, and extending a predetermining longitudinal distance downstream. The overhead compression station 33 assists in maintaining the squareness of the loaded cartons. Overhead compression also aids in providing a more uniform, tight package. The overhead compression station preferably comprises an endless chain 201 with a plurality of vertical squaring lugs 202 having a bottom downstream run of a predetermined longitudinal distance and being disposed a predetermined vertical distance above the article transport conveyor 12. The vertically disposed lugs 202 have a predetermined configuration such that they aid in maintaining the squareness of the cartons 26. One or more overhead compression belts (not shown) may additionally be added for package control purposes.

As shown in FIGS. 1, 6, 24 and 25, gluing, side compression and discharge mechanisms 32 and 37, 34 and 35 are disposed consecutively, further downstream and adjacent the carton supply and transport mechanism 11 to complete the carton flap securement process.

As many changes are possible to the embodiments of this invention utilizing the teachings thereof, the descriptions above, and the accompanying drawings should be interpreted in the illustrative and not the limited sense.

That which is claimed is:

1. A continuous motion cartoning apparatus for loading stacked article groups into cartons, comprising:

a) article infeed means supplying at least two streams of articles, each at a predetermined vertically distinct level and including a guide structure forming article lanes;

b) an article group selection anal transport mechanism intersecting said article lanes to form and transport a longitudinal stream of article groups of a predetermined stacked pattern, said article group selection and transport mechanism comprising a plurality of fixed, transversely oriented, longitudinally moving flight bars intersecting said article lanes at a predetermined angle and selecting articles therefrom to form a lower article subgroup at a first position thereon and an upper article subgroup at a second, downstream position thereon;

c) means, disposed between said first and second positions to deposit a divider structure on said lower article subgroup d) carton supply and transport means disposed adjacent to and parallel with said article group selection and transport mechanism to provide a longitudinal stream of cartons with open ends facing and synchronized with the article groups; and e) a side loading mechanism synchronized with and disposed adjacent said article group selection and transport mechanism and further synchronized with said carton supply and transport means to move the article groups into the cartons, said side loading mechanism comprising support means, moving in parallel synchronization with said article group selection and transport means, movable pushing means operative in a transverse direction, and activation means to move said pushing means at predetermined positions in a travel path.

2. The cartoning apparatus of claim 1, wherein a first article stream intersects said group selection and transport mechanism at said first position, and a second article stream intersects said article group selection and transport mechanism at said second position.

3. The cartoning apparatus of claim 1, wherein said article infeed means comprises at least two conveyor mechanisms.

4. The cartoning apparatus of claim 3, wherein said guide structures have end portions which are constructed and arranged to allow said flight bars to select articles from said article lanes.

5. The cartoning apparatus of claim 1, wherein said article group selection and transport mechanism further comprises a longitudinally operative conveyor to which said plurality of fixed, transversely oriented flight bars are connected.

6. The cartoning apparatus of claim 5, wherein said flight bars have a predetermined configuration and length, and cooperate with said article infeed means to select articles therefrom.

7. The cartoning apparatus of claim 1, wherein said carton supply and transport means comprises a rotary placer, and a longitudinally operative conveyor disposed below said placer and having a plurality of spaced lugs between which the cartons are disposed.

8. The cartoning apparatus of claim 2, wherein the carton includes an outer structure with top, bottom, front and rear sides, and open ends bounded by end flaps, and an inner divider structure which is disposed between an upper article subgroup and a lower article subgroup of the stacked article group.

9. The cartoning apparatus of claim 8, wherein said article group selection and transport means further comprises means to stabilize the selected stacked group.

10. The cartoning apparatus of claim 9, further comprising means to stabilize the carton during said transfer of the stacked article group into the carton.

11. The cartoning apparatus of claim 10, wherein said lower article subgroup is slidingly formed at said first position, and said upper article subgroup is slidingly formed at said second position.

12. The cartoning apparatus of claim 11, wherein said upper article subgroup is slidingly moved across the divider structure while forming the stacked article group on said article group selection and transport means.

13. The cartoning apparatus of claim 11, further comprising means to stabilize the divider structure in its operative position on said lower article subgroup.

14. The cartoning apparatus of claim 9, further comprising means to square the carton subsequent to said transfer of the stacked article group thereinto, said means to square including vertical squaring lugs.

15. A method of continuously loading cartons with stacked article groups having upper and lower sub-groups of articles, comprising the steps of:

a) supplying first input stream of articles at a first location;

b) selecting articles with flight bars at said first location to form a lower article sub-group;

c) transporting the lower article sub-group longitudinally to a second location;

d) supplying a second input stream of articles at said second location;

e) selecting articles with said flight bars at said second location to form an upper article sub-group on top of the lower article sub-group to thereby form a stacked article group, said selection step being implemented by placing a support base on a top surface of said lower article sub-group to provide a low friction surface upon which said upper article sub-group is slidably formed;

f) supplying and longitudinally transporting a carton in spacial synchronization with the stacked article group; and g) laterally transferring the stacked article group into the longitudinally transported carton.

16. A continuous motion cartoning apparatus for loading stacked article groups into cartons having an outer structure with top, bottom, front and rear sides, and open ends bounded by end flaps, and a separate inner divider structure which is disposed between an upper article sub-group and a lower article sub-group, comprising:

a) article infeed means supplying two streams of articles, each at a predetermined vertically distinct level;

b) article group selection and transport means comprising a plurality of flight bars intersecting said article infeed means to form and transport a longitudinal stream of article groups of a predetermined stacked pattern, a first said article stream intersecting said flight bars at a first position thereon to form the lower article sub-group, and a second article stream intersecting said flight bars at a second, distinct position thereon to form the upper article sub-group;

c) a divider structure depositing mechanism disposed between said first and second positions;

d) carton supply and transport means disposed adjacent to and parallel with said article group selection and transport means to provide a longitudinal stream of cartons with open ends facing and synchronized with the article groups; and e) article group transfer means synchronized with said article group selection and transport means and with said carton supply and transport means to move the article groups into the cartons.

17. A continuous motion cartoning apparatus for loading stacked article groups into cartons of a type having an outer structure and a separate inner divider structure, comprising:

a) first article infeed means supplying at least one stream of articles at a first predetermined location and vertical level;

b) second article infeed means supplying at least one stream of articles at a second predetermined location and vertical level said second predetermined location being downstream from said first predetermined location;

c) means, disposed between said first and second location, to deposit the inner divider structure on a lower article subgroup;

d) article group selection and transport means cooperating with said article infeed means to form and transport a longitudinal stream of article groups of a predetermined stack pattern, said article group selection and transport means comprising a plurality of flight bars intersecting said first article infeed means and forming the lower article subgroup at said first predetermined location, said flight bars intersecting said second article infeed means and forming an upper article subgroup over the divider structure at said second predetermined location;

e) carton supply and transport means disposed adjacent to and parallel with said article group selection and transport means to provide a longitudinal stream of cartons with open ends facing and synchronized with said stacked article groups; and f) stacked article group transfer means synchronized with said article group selection and transport means and with carton supply and transport means to move stacked article groups into the cartons.

18. A continuous motion cartoning apparatus for loading cartons with stacked article groups having upper and lower sub-groups of articles, comprising:

a) an article group selection and transport mechanism comprising a plurality of flight bars forming a longitudinally oriented moving stream of article groups of a predetermined stacked pattern including the upper and lower article sub-groups;

b) means to input a stream of articles at a first longitudinal location on said article group selection and transport mechanism and at a first vertical level to form the lower article sub-group;

c) means to place a divider on the lower article sub-group at a second longitudinal location;

d) means to input a stream of articles at third longitudinal location on said article group selection and transport mechanism and at a second vertical level to form the upper article sub-group on the divider;

e) a carton supply and transport mechanism disposed adjacent and parallel to said article group selection and transport mechanism, said carton supply and transport mechanism forming a longitudinally oriented moving stream of cartons which are spacially synchronized with the stacked article groups; and f) a side loading mechanism synchronized to move article groups on said article group selection and transport mechanism into cartons on said carton supply and transport mechanism, said side loading mechanism being disposed adjacent said article group selection and transport means and comprising support means, moving in parallel synchronization with said article group selection and transport means, movable pushing means operative in a transverse direction, and activation means to move said pushing means at predetermined positions in a travel path.

* * * * *